US010646761B2

(12) United States Patent
Early et al.

(10) Patent No.: US 10,646,761 B2
(45) **Date of Patent: *May 12, 2020**

(54) VARIABLE STIFFNESS STRIKING IMPLEMENT

(71) Applicant: Wilson Sporting Goods Co., Chicago, IL (US)

(72) Inventors: James M. Early, Roseville, CA (US); Adam G. Gray, Roseville, CA (US); Jeremy H. Yim, Rocklin, CA (US); Robert A. Lairmore, Oceanside, CA (US); George W. Burger, Rocklin, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/811,356

(22) Filed: Nov. 13, 2017

(65) Prior Publication Data

US 2018/0065011 A1 Mar. 8, 2018

Related U.S. Application Data

(63) Continuation-in-part of application No. 15/289,517, filed on Oct. 10, 2016, now Pat. No. 9,814,956, which (Continued)

(51) Int. Cl.
*A63B 59/50* (2015.01)
*A63B 60/42* (2015.01)

(Continued)

(52) U.S. Cl.
CPC ..... *A63B 60/42* (2015.10); *A63B 59/00* (2013.01); *A63B 59/50* (2015.10); *A63B 59/51* (2015.10);

(Continued)

(58) Field of Classification Search
CPC ..... A63B 59/50–59/58; A63B 2102/18; A63B 2102/182; A63B 2059/581

(Continued)

(56) References Cited

U.S. PATENT DOCUMENTS 3,897,058 A * 7/1975 Koch ..... A63B 69/3632 473/201
4,951,948 A 8/1990 Peng (Continued)

*Primary Examiner* — Jeffrey S Vanderveen
*Assistant Examiner* — Mark S Graham
(74) *Attorney, Agent, or Firm* — Terence P. O'Brien; James C. Eaves, Jr.; Dentons Bingham Greenebaum LLP

(57) ABSTRACT

A variable stiffness striking implement, such as, for example, a ball bat typically used in baseball, softball, or rubber ball. The striking implement, preferably has a separate barrel and handle. A wedge and joint attached directly to the handle or indirectly to the handle using an interface portion engage the interior surface of the barrel. Most preferably, the wedge and joint are molded about the interface portion and a handle preform is then inserted into the intention of the interface portion and the handle is then molded. Wedge hardness is selectable and a stiffness member may also be employed. Stiffness member hardness may be selectable or may be adjustable by varied adjustment of a cap in relation to the barrel. Alternatively, the cap may not be adjustable in relation to the barrel so that a selected stiffness member hardness is fixed.

12 Claims, 12 Drawing Sheets

Related U.S. Application Data is a continuation of application No. 14/957,957, filed on Dec. 3, 2015, now Pat. No. 9,486,680.

(60) Provisional application No. 62/089,486, filed on Dec. 9, 2014.

(51) Int. Cl.

| | |
|---|---|
| ***A63B 59/00*** | (2015.01) |
| ***A63B 59/51*** | (2015.01) |
| ***A63B 59/54*** | (2015.01) |
| *A63B 102/18* | (2015.01) |
| *A63B 60/00* | (2015.01) |
| *A63B 60/16* | (2015.01) |
| *A63B 49/03* | (2015.01) |
| *A63B 71/06* | (2006.01) |
| *A63B 60/48* | (2015.01) |

(52) U.S. Cl.

CPC ..... *A63B 59/54* (2015.10); *A63B 49/03* (2015.10); *A63B 60/16* (2015.10); *A63B 60/48* (2015.10); *A63B 2060/0081* (2015.10); *A63B 2071/0694* (2013.01); *A63B 2102/18* (2015.10); *A63B 2102/182* (2015.10); *A63B 2209/00* (2013.01)

(58) Field of Classification Search

USPC ..... 473/457, 519, 520, 564–568, 305–310

See application file for complete search history.

(56) References Cited

U.S. PATENT DOCUMENTS

| | | | | |
|---|---|---|---|---|
| 5,133,551 | A * | 7/1992 | Handy | A63B 59/59 473/567 |
| 5,219,164 | A | 6/1993 | Peng | |
| 5,593,158 | A | 1/1997 | Filice et al. | |
| 6,485,382 | B1 | 11/2002 | Chen | |
| 6,511,392 | B1 * | 1/2003 | Chohan | A63B 59/50 473/564 |
| 6,702,698 | B2 | 3/2004 | Eggiman et al. | |
| 6,743,127 | B2 | 6/2004 | Eggiman et al. | |
| 6,945,886 | B2 | 9/2005 | Eggiman et al. | |
| 7,052,419 | B2 | 5/2006 | Chang | |
| 7,097,578 | B2 | 8/2006 | Guenther et al. | |
| 7,128,670 | B2 | 10/2006 | Souders et al. | |
| 7,166,046 | B1 | 1/2007 | Liu | |
| 7,201,679 | B2 | 4/2007 | Nguyen | |
| 7,261,654 | B2 | 8/2007 | Cheng | |
| 7,311,620 | B1 | 12/2007 | Heald et al. | |
| 7,377,866 | B2 | 5/2008 | Van Nguyen | |
| 7,381,141 | B2 | 6/2008 | Van Nguyen | |
| 7,410,433 | B2 | 8/2008 | Guenther et al. | |
| 7,419,446 | B2 | 9/2008 | Nguyen | |
| 7,572,197 | B2 | 8/2009 | Chauvin et al. | |
| 7,798,926 | B1 * | 9/2010 | Hsu | A63B 59/51 473/566 |
| 7,942,764 | B2 | 5/2011 | Chung | |
| 7,980,970 | B2 | 7/2011 | Watari et al. | |
| 8,083,619 | B1 * | 12/2011 | Turos | A63B 69/0002 473/457 |
| 8,226,505 | B2 | 7/2012 | Burger | |
| 8,313,397 | B2 | 11/2012 | Watari et al. | |
| 8,491,423 | B1 * | 7/2013 | Biggio | A63B 60/46 473/457 |
| 8,894,518 | B2 | 11/2014 | Chung | |
| 9,138,625 | B2 * | 9/2015 | Chung | A63B 60/54 |
| 9,242,156 | B2 | 1/2016 | Goodwin et al. | |
| 9,486,680 | B2 | 11/2016 | Burger et al. | |
| 9,511,267 | B2 * | 12/2016 | Thurman | G06Q 30/0621 |
| 9,669,277 | B1 * | 6/2017 | Haas | A63B 60/06 |
| 9,731,180 | B2 | 8/2017 | Goodwin et al. | |
| 9,802,094 | B2 | 10/2017 | Goodwin et al. | |
| 9,814,956 | B2 * | 11/2017 | Burger | A63B 59/50 |
| 9,956,464 | B2 * | 5/2018 | Moritz | A63B 59/50 |
| 10,016,667 | B2 * | 7/2018 | Van Nguyen | A63B 59/54 |
| 2004/0224803 | A1 * | 11/2004 | Forsythe | A63B 59/50 473/564 |
| 2006/0252586 | A1 * | 11/2006 | Nguyen | A63B 59/59 473/564 |
| 2007/0142135 | A1 * | 6/2007 | Cheng | A63B 59/54 473/564 |
| 2007/0191156 | A1 * | 8/2007 | Van Nguyen | A63B 59/51 473/564 |
| 2007/0207882 | A1 * | 9/2007 | Van Nguyen | A63B 59/50 473/564 |
| 2008/0058132 | A1 * | 3/2008 | Nguyen | A63B 59/50 473/564 |
| 2011/0111892 | A1 * | 5/2011 | Thouin | A63B 60/10 473/520 |

* cited by examiner

VARIABLE STIFFNESS STRIKING IMPLEMENT

This application is a continuation-in-part application of continuation U.S. application Ser. No. 15/289,517, filed Oct. 10, 2016, for VARIABLE STIFFNESS STRIKING IMPLEMENT, which was a continuation application of U.S. patent application Ser. No. 14/957,957, filed Dec. 3, 2015, for VARIABLE STIFFNESS STRIKING IMPLEMENT, now U.S. Pat. No. 9,486,680, issued Nov. 8, 2016, which claims the benefit of U.S. provisional patent application Ser. No. 62/089,486, filed Dec. 9, 2014, for VARIABLE STIFFNESS BAT, all incorporated herein by reference.

BACKGROUND OF THE INVENTION

Field of the Invention

The present invention relates to a variable stiffness striking implement, such as, for example, a ball bat typically used for striking a ball in a game of baseball or softball or rubber ball.

SUMMARY OF THE INVENTION

The present invention relates to a variable stiffness striking implement, such as, for example, a ball bat typically used in baseball, softball, or rubber ball. However, the variable stiffness features taught herein have application in striking implements used for other than hitting a baseball, softball, or rubber ball; such as, for example, without limitation, use in cricket, tennis, or hockey. Hereinafter, for ease of reference but without limitation, the striking implement of the present invention will be referred to as a bat.

The bat, preferably having a separate barrel and handle includes a variable stiffness assembly which results in the user being able to adjust the stiffness of the bat. This is accomplished by the user selecting a stiffness member having a desired hardness and inserting the selected stiffness member around the handle and abutting the end of the barrel closest to the handle end of the bat and using a cap to hold the stiffness member in place, or, if desired by the user, the bat may be used without a stiffness member. Each of these configurations will provide a different stiffness, as explained herein. The barrel and handle may be made of any known material used in manufacturing bats and the barrel and handle may be made of the same or different materials. The bat end cap and knob are also of known construction and compatible with the materials selected for manufacture of the barrel and handle.

Further, in some embodiments, a wedge and joint are attached directly to the handle or indirectly to the handle using an interface portion engage the interior surface of the barrel. Most preferably, the wedge and joint are molded about the interface portion and a handle preform is then inserted into the intention of the interface portion and the handle is then molded. Wedge hardness is selectable and a stiffness member may also be employed. Stiffness member hardness may be selectable or may be adjustable by varied adjustment of a cap in relation to the barrel. Alternatively, the cap may not be adjustable in relation to the barrel so that a selected stiffness member hardness is fixed.

The present invention is for a striking implement, comprising: a barrel, the barrel having a barrel end cap end and a barrel handle end and a barrel interior surface, the barrel having an internal joint receiving portion toward the barrel handle end; a handle, the handle having a handle knob end and a handle barrel end; an interface portion, the interface portion having an interface portion barrel end and an interface portion handle end, the interface portion having a joint receptacle and an interface portion stiffness member receiving portion and an interface portion coupling portion, the interface portion coupling portion being located closer to the interface portion handle end than the joint receptacle and the interface portion stiffness member receiving portion being located between the joint receptacle and the interface portion coupling portion; the interface portion being received over the handle and secured thereto, the interface portion handle end being orientated toward the handle knob end; the interface portion joint receptacle receiving a joint therein, the interface portion receiving at least a portion of a wedge thereover, the wedge being located closer to the interface portion barrel end than the joint receptacle; the handle with the interface portion being received into the barrel with at least a portion of an exterior surface of the wedge engaging the barrel interior surface, the joint received in the interface portion joint receptacle also being received in the barrel internal joint receiving portion, the interface portion stiffness member receiving portion and the interface portion coupling portion extending external of the barrel from the barrel handle end; a cap having a cap barrel end and a cap knob end, the cap having a cap coupling portion; and, the cap being inserted over the handle with the cap barrel end oriented toward the barrel and the cap coupling portion engageable with the interface portion coupling portion.

In one implementation, the cap can engage the barrel handle end, while in another implementation, the cap cannot engage the barrel handle end.

The striking implement of this invention may also include a stiffness member received by the interface portion stiffness member receiving portion and where the cap is coupled onto the interface portion coupling portion such that the stiffness member is held between the barrel handle end and the cap barrel end. With two implementations, the stiffness member may have a uniform hardness or the stiffness member may have a harder durometer portion and a softer durometer portion. In this latter implementation, the harder durometer portion abuts the cap barrel end and the softer durometer portion abuts the barrel handle end. Also, the stiffness member may have a slit therethrough.

More specifically, the cap may have an inward notched portion at its barrel end and the stiffness member may have a notched portion insert received into the cap inward notched portion. Further, the barrel handle end may angle inward and the stiffness member may have a barrel engaging end which abuts the angled inward barrel handle end.

Further, the interface portion coupling portion and the cap coupling portion may have engageable threads thereon.

There are two implementations of the wedge of the instant invention. In one, the wedge may engage the interface portion and the barrel interior surface, but not engage the handle. In the other, the wedge engages the interface portion and the handle, and where the wedge engages the barrel interior surface, the wedge has a portion nearest the handle barrel end where the wedge engages the handle but not the barrel interior surface.

Even more specifically, the striking implement of the present invention may be a bat where the barrel has an end cap at its end cap end, the barrel has a uniform diameter portion toward its end cap end and a tapered portion toward the barrel handle end, where the exterior surface of the wedge engaging the barrel interior surface is in the tapered portion, and where the handle has a knob at the handle knob end.

In additional embodiments, the present invention is for a striking implement comprising a handle, the handle having a handle knob end and a handle barrel end, the handle having a wedge thereround toward the handle barrel end and a joint thereround closer to the handle knob end than the wedge; a barrel, the barrel having a barrel end cap end and a barrel handle end and a barrel interior surface, the barrel having an internal joint receiving portion toward the barrel handle end; the handle with the wedge and the joint thereround being partially received by the barrel, where the joint is received by the barrel joint receiving portion and where at least a portion of an outer wedge surface engages a portion of the barrel interior surface, the outer wedge surface engaging the barrel interior surface further from the barrel handle end than where the joint is received. Also, the present invention is for a ball bat extending along a longitudinal axis and configured for impacting a ball, the bat comprising a barrel extending along the longitudinal axis and having a barrel end cap end region, a barrel handle end region and an interior surface; a handle extending along the longitudinal axis and having a length, a handle knob end and a handle barrel end, the handle having a uniform diameter along the length of the handle; a pivot joint element coupled to the handle and pivotally engaging the barrel handle end region of the barrel, the pivot joint element enabling pivotal movement of the barrel with respect to the handle upon an impact with the ball; a first biasing element coupled to the handle and to the interior surface of the barrel, the first biasing element urging the barrel back into co-axial alignment with the handle following the impact with the ball. Also, a second biasing element can also be coupled to the handle and positioned adjacent to the barrel handle end region, wherein the second biasing element urging the barrel back into co-axial alignment with the handle following the impact with the ball. Even further, the present invention comprises a striking implement assembly having an interface portion, the interface portion having a uniform inside diameter portion and an outer surface, along with a handle end and a barrel end; where moving along the interface portion outer surface from the handle end toward the barrel end, the outer surface includes a coupling portion, a stiffness member receiving portion, at least one joint receiving ridge, and a wedge receiving portion; a joint being positioned around the interface portion outer surface, the joint having at least one channel corresponding to the at least one joint receiving ridge; and a wedge having a wedge end cap end and a wedge knob end and a wedge interior surface, the wedge being positioned around the interface portion outer surface such that the wedge interior surface engages the wedge receiving portion of the outer surface of the interface portion.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein is not necessarily intended to address every object described herein, and each embodiment does not necessarily include each feature described. Other forms, embodiments, objects, advantages, benefits, features, and aspects of the present invention will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
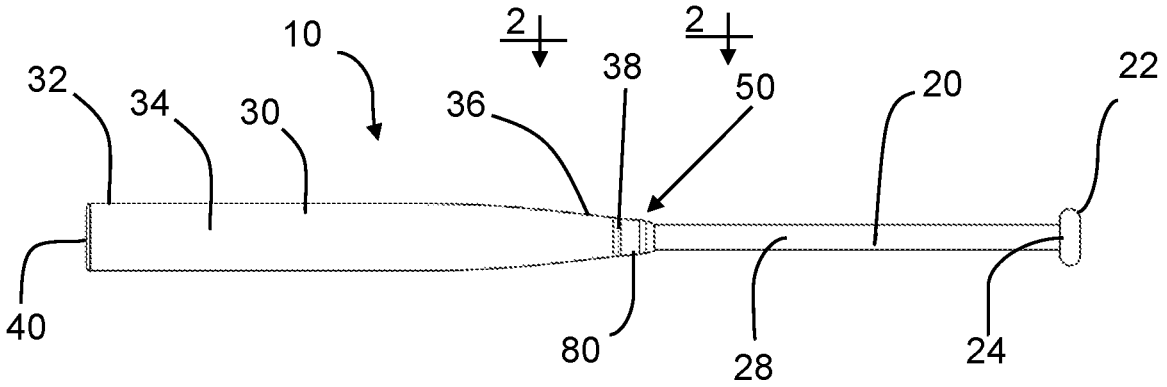
FIG. 1 is an external perspective view of one implementation of a variable stiffness ball bat of the present invention, typically used in playing softball.

For the purposes of promoting an understanding of the principles of the invention, reference will now be made to selected embodiments illustrated in the drawings and specific language will be used to describe the same. It will nevertheless be understood that no limitation of the scope of the invention is thereby intended; any alterations and further modifications of the described or illustrated embodiments, and any further applications of the principles of the invention as illustrated herein are contemplated as would normally occur to one skilled in the art to which the invention relates. At least one embodiment of the invention is shown in great detail, although it will be apparent to those skilled in the relevant art that some features or some combinations of features may not be shown for the sake of clarity.

Any reference to "invention" within this document herein is a reference to an embodiment of a family of inventions, with no single embodiment including features that are necessarily included in all embodiments, unless otherwise stated. Further, although there may be references to "advantages" provided by some embodiments of the present invention, it is understood that other embodiments may not include those same advantages, or may include different advantages. Any advantages described herein are not to be construed as limiting to any of the claims.

Specific quantities (spatial dimensions, angles, dimensionless parameters, etc.) may be used explicitly or implicitly herein, such specific quantities are presented as examples and are approximate values unless otherwise indicated. Discussions pertaining to specific compositions of matter are presented as examples and do not limit the applicability of other compositions of matter, especially other compositions of matter with similar properties, unless otherwise indicated.

Figure 2:
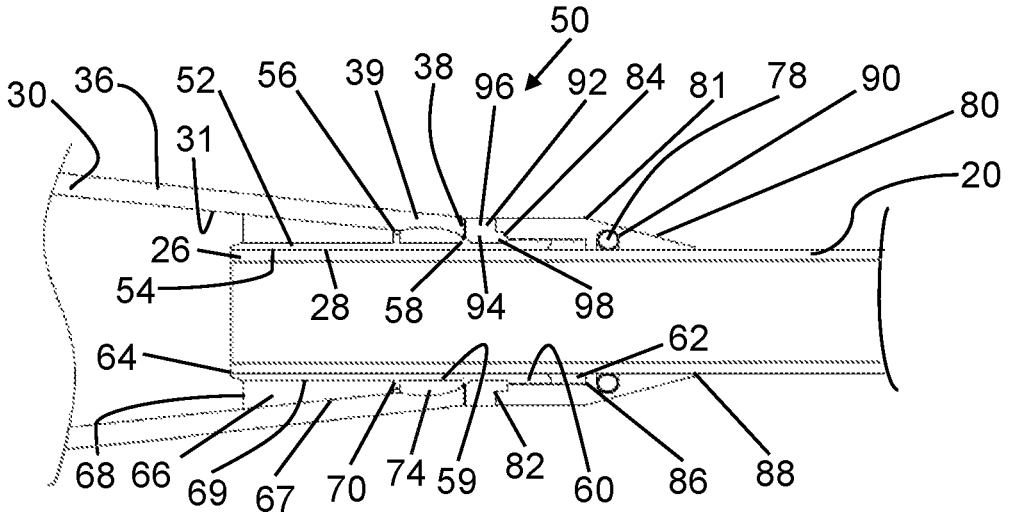
FIG. 2 is a cross-section view of a portion of the bat of FIG. 1 along the lines 2-2 shown in FIG. 1, the section view showing a stiffness member received between the end of the barrel and the cap.
Figure 3:
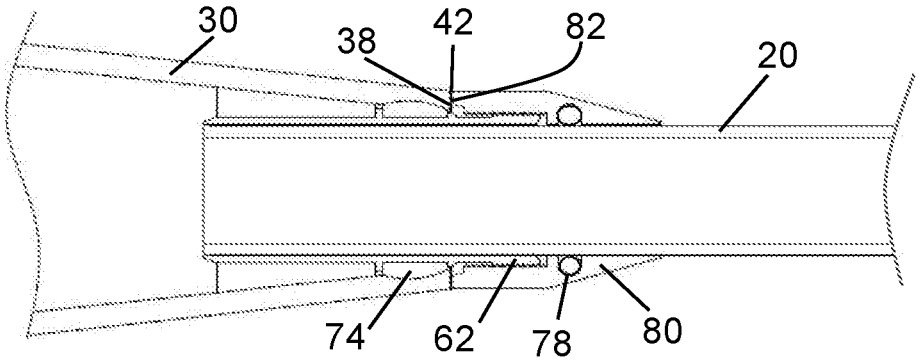
FIG. 3 is a similar cross-section view to that of FIG. 2, but without a stiffness member, where the end of the barrel engages the cap.
Figure 4:
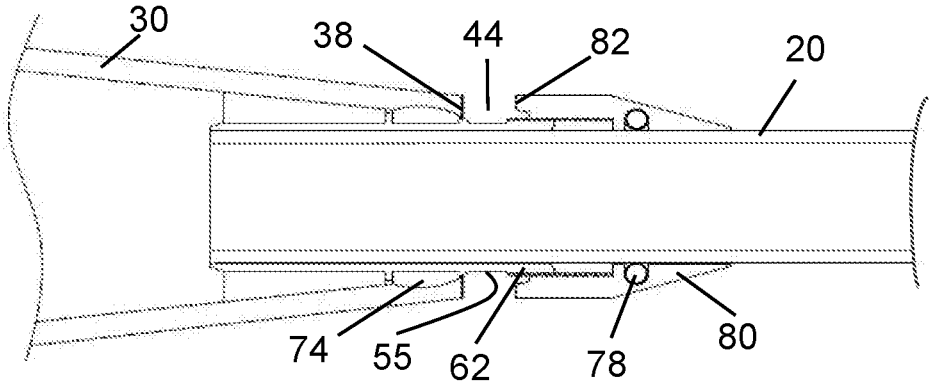
FIG. 4 is a similar cross-section view to that of FIGS. 2 and 3, without a stiffness member, where the end of the barrel does not engage the cap.
Figure 5:
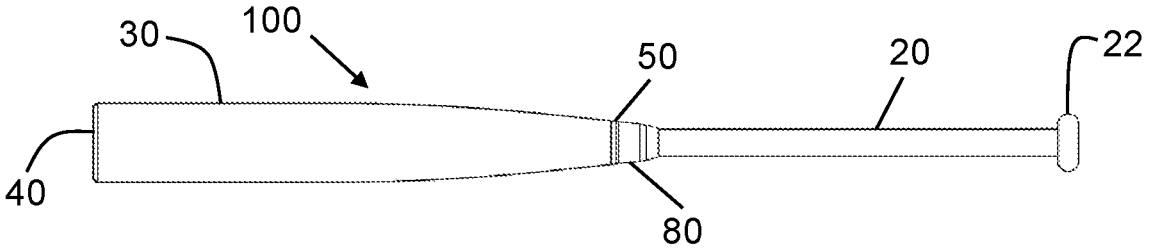
FIG. 5 is a perspective view of another implementation of a variable stiffness ball bat of the present invention, typically used in playing baseball.

It is noted that two embodiments of a bat where the stiffness is variable are shown in the figures, the first embodiment being shown specifically in FIGS. 2-4 and the second embodiment being shown specifically in FIGS. 6-10. Either of these two embodiments may be included in a softball bat such as shown in FIG. 1, a baseball bat such as shown in FIG. 5, a rubber ball bat, or other striking implement.

With reference now to FIGS. 1-5, the following cross-reference relates the identified items and their corresponding numbers. Variable stiffness ball bat 10, 100; handle 20; knob 22; handle knob end 24; handle barrel end 26; handle distal portion 28 having a uniform outside diameter; barrel 30; barrel interior surface 31; barrel end cap end 32; barrel portion 34 having a generally uniform outer diameter; barrel tapered portion 36; barrel handle end 38; barrel joint receiving portion 39; end cap 40; location 42; gap 44; variable stiffness assembly 50; interface portion 52; interface portion uniform inside diameter portion 54; interface portion stiffness member receiving portion 55; interface portion first stop 56; interface portion second stop 58; interface portion joint receptacle 59; interface portion coupling portion 60; interface portion handle end 62; interface portion barrel end 64; wedge 66; wedge exterior surface 67; wedge end cap end 68; wedge interior surface 69; wedge knob end 70; joint 74; o-ring 78; cap 80; cap exterior surface 81; cap barrel end 82; cap notched portion 84; cap coupling portion 86; cap knob end 88; cap o-ring channel 90; stiffness member 92; stiffness member larger thickness interior portion 94; stiffness member small thickness exterior portion 96; and stiffness member notch portion insert 98.

With reference now to FIGS. 6-10, the following cross-reference relates the identified items and their corresponding numbers. Handle 20; handle barrel end 26; barrel 130; barrel interior surface 131; barrel tapered portion 136; barrel handle end 138; barrel joint receiving portion 139; gap 144; variable stiffness assembly 150; interface portion 152; interface portion uniform inside diameter portion 154; interface portion stiffness member receiving portion 155; interface portion first stop 156; interface portion second stop 158; interface portion joint receptacle 159; interface portion coupling portion 160; interface portion handle end 162; interface portion barrel end 164; wedge 166; wedge exterior surface 167; wedge end cap end 168; wedge interior surface 169; wedge knob end 170; wedge portion abutting interface portion on the wedge interior surface and barrel on the wedge exterior surface 171; wedge portion abutting handle on wedge interior surface and barrel on wedge exterior surface 172; wedge portion abutting handle on wedge interior surface but not abutting barrel 173; joint 74; o-ring 78; cap 180; cap exterior surface with raised ribs 181; cap barrel end 182; cap notched portion 184; cap coupling portion 186; cap knob end 188; cap o-ring channel 190; decorative band 191; stiffness member 192; harder durometer portion 193; stiffness member larger thickness interior portion 194; softer durometer portion 195; stiffness member small thickness exterior portion 196; slit 197; stiffness member notch portion insert 198; notch 199; and barrel engaging end 200.

Figure 11:
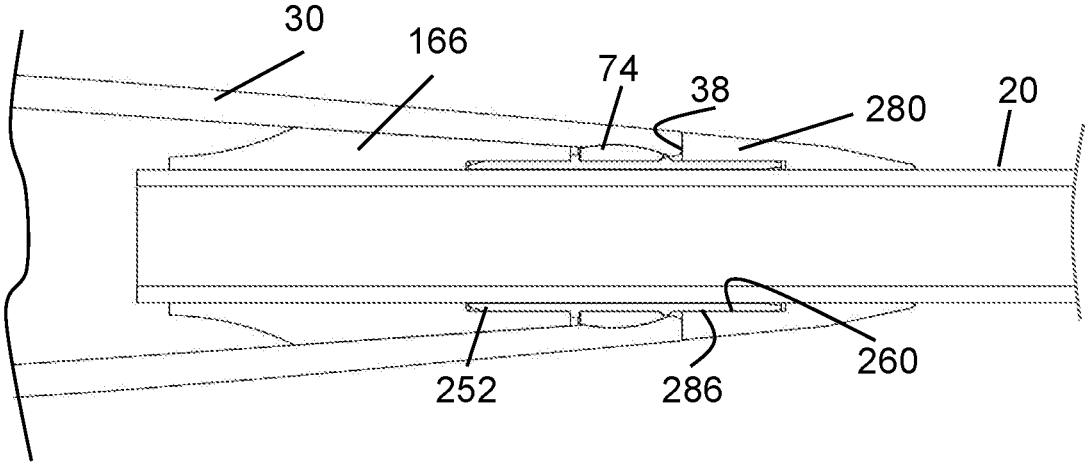
FIG. 11 is a cross-section view of a portion of a bat showing a cap which provides a stiffness member function.

With reference to FIG. 11, the following cross-reference relates the identified items and their corresponding numbers. Handle 20; barrel 30; barrel end 38; joint 74; interface portion 252; interface portion coupling portion 260; cap 280; and cap coupling portion 286.

With reference to FIGS. 12-20, the following cross-reference relates to the identified items and their corresponding numbers. Ball 12; bat 300; handle 320; knob 322; handle knob end 324; handle barrel end 326; barrel 330; barrel interior surface 331; barrel end cap end 332; barrel portion having a generally uniform outside diameter 334; barrel tapered portion 336; barrel handle end 338; barrel joint receiving portion 339; end cap 340; interface portion 352; interface portion stiffness member inner flat surface receiving portion 353; interface portion uniform inside diameter portion 354; interface portion stiffness member receiving portion 355; interface portion stiffness member notched portion 357; interface portion coupling portion 360; interface portion joint receiving ridge 361; interface portion handle end 362; interface portion outer surface 363; interface portion barrel end 364; interface portion wedge receiving portion 365; wedge 366; wedge exterior surface 367; wedge end cap end 368; wedge interior surface 369; wedge knob end 370; wedge portion abutting interface portion on the wedge interior and barrel on the wedge exterior 371; wedge tapered portion 373; joint (or socket) 374; outer central portion 375; joint channel to receive joint receiving ridge of the interface portion 376; curved barrel engaging surface 377; cap 380; cap exterior surface 381; cap barrel end 382; ridges on cap to facilitate cap tightening/loosening 383; cap notched portion 384; cap coupling portion 386; cap knob end 388; decorative band 391; indicia 399; stiffness member 392; stiffness member barrel engaging end 401; stiffness member cap engaging end 402; stiffness member exterior surface 403; stiffness member interior flat surface 404; stiffness member tab 405; and stiffness member cap notched portion tab 406. In addition to some of the reference numbers used in FIGS. 12-20, these additional reference numbers are used in FIGS. 21A-24: housing 393; bat 400; stiffness member 492; joint 474, cap 480; bat 500; cap 580; stiffness member layer 693, stiffness member 694, and stiffness member layer 695.

With reference to FIGS. 1 and 2, a variable stiffness ball bat 10 is shown in full in FIG. 1 and a portion of the bat is shown in cross-section in FIG. 2 along the lines 2-2 shown in FIG. 1. This bat 10 is designed for use in playing softball. FIG. 5 shows a similar bat 100, but bat 100 is designed for use in playing baseball. In general, it is typical that the barrel of a baseball bat, such as bat 100, has a shorter length uniform diameter portion and a longer tapered portion in comparison to that of a softball bat, such as bat 10. Bats 10 and 100 represent conventional softball and baseball bat shapes and other shapes of softball and baseball bats can be used with the variable stiffness assembly 50 of the instant invention. For example, this invention could be employed with rubber ball bats typically used in Japan, those bats having barrels similar to baseball bats, or with other similar striking implements. Both bats 10 and 100 have a handle 20 with a conventional knob 22 attached thereto and a barrel 30 having a conventional end cap 40. Handle 20 and barrel 30 are preferably separate pieces, where a portion of handle 20 is received within barrel 30 at the variable stiffness interface portion 50.

With further reference to FIGS. 1 and 2, bat 10 is seen having handle 20 having a knob end 24, which receives knob 22 thereon, a barrel end 26, and a distal portion 28 having a generally uniform outside diameter. In one implementation, the entire handle 20 can have a uniform outside diameter. In another implementation, the outside diameter of the handle can be varied along its length. Barrel 30 has an end cap end 32, which receives an end cap 40, a generally uniform diameter portion 34, a tapered portion 36, a handle end 38, and a joint receiving portion 39. Joint receiving portion 39 is a recessed area on the interior of the barrel 30 toward the handle end 38 and is formed during manufacture of the barrel 30. The joint receiving portion 39 is shown having one particular shape. In other implementations, the joint receiving portion 39 can be formed in other curved shapes.

Variable stiffness assembly 50 comprises an interface portion 52, a wedge 66, a joint 74, an o-ring 78, a cap 80, and may or may not include a stiffness member 92.

Interface portion 52 is preferably made of aluminum and is generally of cylindrical shape. In other implementations, the interface portion 52 can be formed of other materials, such as, for example, a fiber composite material, a polymeric material, titanium, other metals, or combinations thereof. It has a uniform inside diameter portion 54 which is sized so that the distal portion 28 of handle 20 can be received therein, and preferably adhesively affixed therein toward the barrel end 26 of handle 20. While the outer surface of interface portion 52 is generally cylindrical, from its barrel end 64 toward its handle end 62, there is a first stop 56 and a second stop 58, these first stop 56 and second stop 58 creating a joint receptacle 59 therebetween. From the handle end 62 of the interface portion 50 for a distance along the outer surface thereof toward the barrel end 64 is a coupling portion 60. Between second stop 58 and coupling portion 60 is an interface portion stiffness member receiving portion 55. From the barrel end 64 toward the first stop 56, the preferably aluminum outer surface of interface portion 52 is preferable grit blasted for better adhesion with the interior surface 69 of a wedge 66. In other implementations, other surface treatments or no surface treatment can be used.

Wedge 66 has the shape of a truncated conical section or frustum with a center cylindrical opening therethrough. Wedge 66 has an end cap end 68, a knob end 70, an interior surface 69 and an exterior surface 67. Wedge 66 is preferably made of EPDM rubber with a preferable hardness of about 45 Shore A. In other implementations, the wedge can be formed of other rubbers, other elastomeric materials, or combinations thereof.

Cap 80, preferably made of aluminum, has an exterior surface 81 which is, for example without limitation, gnarled or fluted to assist one in rotating the cap 80. In other implementations, the cap 80 can be formed of other materials, such as, for example, a fiber composite material, a polymeric material, a plastic, titanium, other metals, or combinations thereof.

Cap 80 has a barrel end 82 with a notched portion 84 at the barrel end. From the notched portion 84, along the inside surface of the cap 80 toward the knob end 88, is a coupling portion 86. As is shown in FIGS. 2-4, coupling portion 86 of cap 80 and coupling portion 60 of interface portion 52 are threaded. As such, cap 80 can be coupled to interface portion 52 at respective coupling portions 86 and 60 by threading cap 80 onto the threads of coupling portion 60. Preferably, these coupling portions 86 and 60 have threads with 32 teeth per inch (2.54 cm). In other implementations, other teeth per inch thread counts can be used. Between the coupling portion 86 and knob end 88 is an o-ring channel 90 which receives an o-ring 78 therein. O-ring 78 will exert friction between the handle 20 and the cap 80 so that the cap 80 will not rotate without an outside force being exerted thereon. In another implementation, the cap and interface portion can include coupling mechanisms other than a threaded connection, such as, for example, a press-fit connection, a slotted quarter-turn connection, a ball and groove connection, a tongue and groove connection, resilient tabs and/or notches, and combinations thereof. Even further, cap 80 and interface portion 52 can be permanently coupled by, for example, adhesively affixing them together.

A stiffness member 92 is shown having a larger thickness interior portion 94, a smaller thickness exterior portion 96, and a notch insert portion 98. Stiffness members can be made of various hardness and size. For example, without limitation, stiffness members 92 can have a hardness of from 30 Shore A to 50 Shore D. As an example, a user could elect to use a stiffness member 92 with a hardness of 30 Shore A, or a different member with a hardness of 60 Shore A, or a different member with a hardness of 90 Shore A. Similarly, the shape of the stiffness member can also be varied. The use, or non-use, of one of these stiffness members 92 will be explained hereinafter.

To assemble the bat 10 or 100, as seen in FIG. 1 or 5, for the first embodiment of FIGS. 2-4, the barrel 30, having the joint receiving portion 39 on its inside surface near handle end 38, and a separate handle 20 are manufactured, both preferably made of a graphite material, although other known materials may be used and the barrel and handle may be of same or different materials. The end cap 40 and the knob 22 will be attached later.

First, interface portion 52, with its coupling portion 60 oriented toward the handle knob end 24, is inserted over and glued on to handle 20 toward the handle barrel end 26. The glue is allowed to cure so that interface portion 52 is securely attached to handle 20. Next, the joint 74, preferably made of a nylon material, is snapped into position over the interface portion 52 between the first stop 56 and second stop 58. In other implementations, for example, the joint can be formed of a plastic, a metal, a fiber composite material, or combinations thereof. Next, the wedge 66 is glued onto interface portion 52, such that the wedge knob end 70 abuts first stop 56, and the glue is allowed to cure.

This handle 20, with interface portion 52, with joint 74, and wedge 66 is ready for insertion into the barrel 30. Wedge 66 has glue placed on its exterior surface 67. The handle 20 is now inserted into the barrel end cap end 32 of barrel 30, the handle 20 having its handle knob end 24 inserted first. The handle barrel end 26 has force applied to it until the joint 74 is received into barrel joint receiving portion 39, which also means that the wedge exterior surface 67 with glue thereon engages the barrel interior 31. In this configuration, the interface portion stiffness member receiving portion 55 and interface portion coupling portion 60 extend externally of the barrel 30 beyond barrel handle end 38. In another implementation, the wedge may be installed without an adhesive on one or both of the interior surface 69 and the exterior surface 67.

With the handle 20 and barrel 30 connected by joint 74 and wedge 66, cap 80, with o-ring 78 inserted into o-ring channel 90, is inserted over handle knob end 24, cap 80 having its barrel end 82 oriented toward the barrel handle end 38. Cap 80 is moved toward handle barrel end 26 so that coupling portion 86 of cap 80 can engage interface portion coupling portion 60. A conventional end cap 40 and knob 22, known in the art, can now be affixed to barrel 30 and handle 22, respectively.

The bats of the present invention can be used with a selected stiffness member 92 having a desired hardness or no stiffness member can be used. With specific reference to the first embodiment of FIGS. 2, 3, and 4, FIG. 4 shows the bat with the cap 80 threaded partly on to the interface portion 52, where no stiffness member 92 is employed, so that there is a gap 44 between the barrel end 82 of cap 80 and handle end 38 of barrel 30. For the configurations shown in FIGS. 2, 3, and 4, this configuration of FIG. 4 results in a bat with the least stiffness. When looking at the bat of FIG. 3, at location 42, it is seen that cap 80 has been threaded onto interface portion 52 so that barrel end 82 of cap 80 and handle end 38 of barrel 30 are touching. This configuration of FIG. 3 results in a bat with the most stiffness. In contrast, with the bat of FIG. 2, a stiffness member 92 of desired hardness has been selected and inserted onto interface portion stiffness member receiving portion 55 so that it's larger thickness interior portion 94 engages the interface portion 52 so that notched portion 98 can be received by notched portion 84 of cap 80. With the cap 80 threaded onto the interface portion 52 as shown, stiffness member 92 will provide a bat with a stiffness between that of the bat of FIG. 4 and the bat of FIG. 3.

With this first embodiment of FIGS. 2-4, as well as with the second embodiment of FIGS. 6-10 explained below, various options are possible for the bat user. The user could obtain a bat having, for example, a set of three stiffness members. These stiffness members could be of any hardness, but, for example, we will say the stiffness members have hardnesses of 30 Shore A, 60 Shore A, and 90 Shore A. The user can then try the bat with the different hardness stiffness members and select one hardness to use all of the time or change as the user desires. If a replacement stiffness member is needed, the user can obtain just the desired hardness stiffness member or another set. Alternatively, the user could try out or test a bat, for example at a batting cage or sporting goods store, and then obtain a bat having just the desired hardness stiffness member. As such, each bat is customizable to the specific user with the stiffness member being replaceable. It is noted that, if a user only desires a specific hardness, the bat of the instant invention can be provided with the desired stiffness member with the cap permanently coupled to the interface portion. Even further, in this configuration, as an option, the stiffness member and the cap can be combined into a single piece. Where the cap is to be permanently coupled to the interface portion, o-ring channel 90 in cap 80 and o-ring 78 could be eliminated. An example of this implementation is demonstrated in FIG. 11. FIG. 11 includes handle 20, barrel 30 with barrel end 38, joint 74, interface portion 252 with interface portion coupling portion 260 but with no stiffness member receiving portion, and cap 280 with cap coupling portion 286. In this implementation, the stiffness member is integrated into cap 280, as cap 280 can be made of any desired hardness, for example, from 30 Shore A to 50 Shore D. One user may elect a bat with a cap having a hardness of 90 Shore A, while another user may elect a bat with a cap having a hardness of 60 Shore A. This implementation of FIG. 11 is shown without an o-ring channel or an o-ring and the cap is permanently coupled.

With reference to FIGS. 6-10, a second embodiment is shown and the differences between this second embodiment and the first embodiment of FIGS. 2-4 will be explained. If not mentioned with this description of FIGS. 6-10, the elements and assembly are the same as described above for the first embodiment of FIGS. 2-4.

Figure 6:
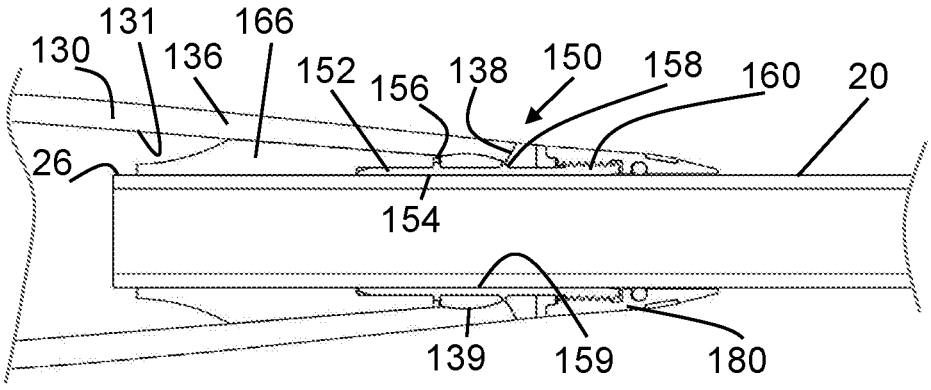
FIG. 6 is a cross-section view of a portion of the bat of FIG. 1 along the lines 2-2 shown in FIG. 1, the section view showing a stiffness member received between the end of the barrel and the cap, the interior of this bat having a different internal structure than that shown in FIGS. 2-4.
Figure 7:
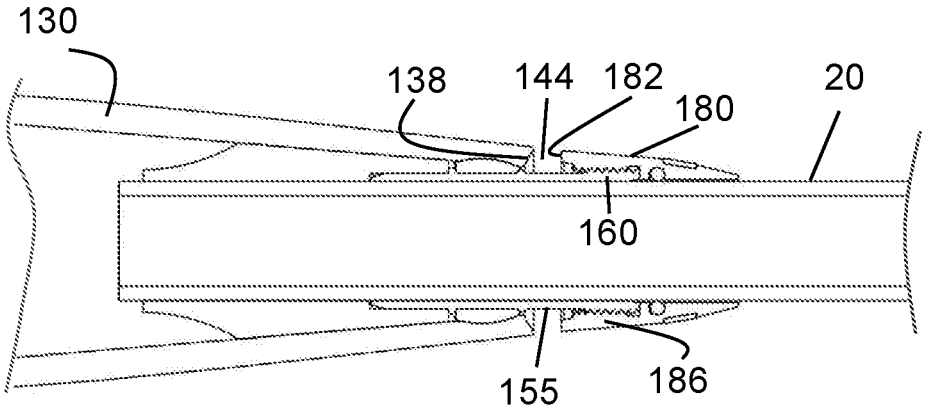
FIG. 7 is a similar cross-section view to that of FIG. 6, but without a stiffness member, where the end of the barrel cannot engage the cap.
Figure 8:
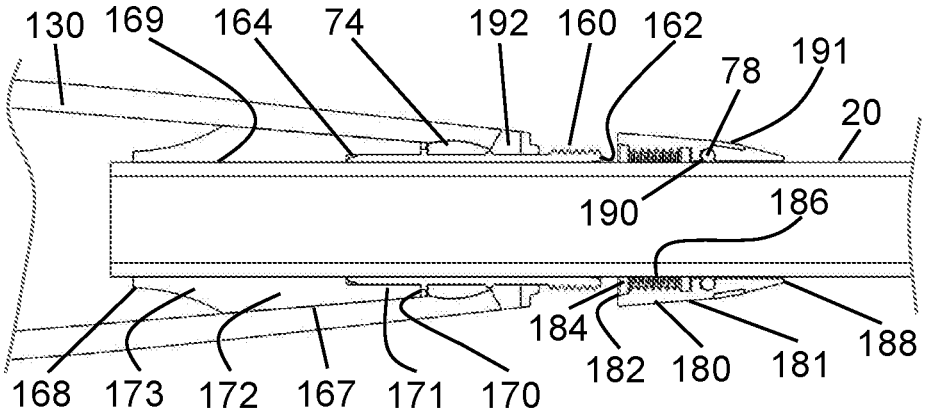
FIG. 8 is a similar cross-section view to that of FIGS. 6 and 7, without a stiffness member, where the cap is shown at its uncoupled location.
Figure 9:
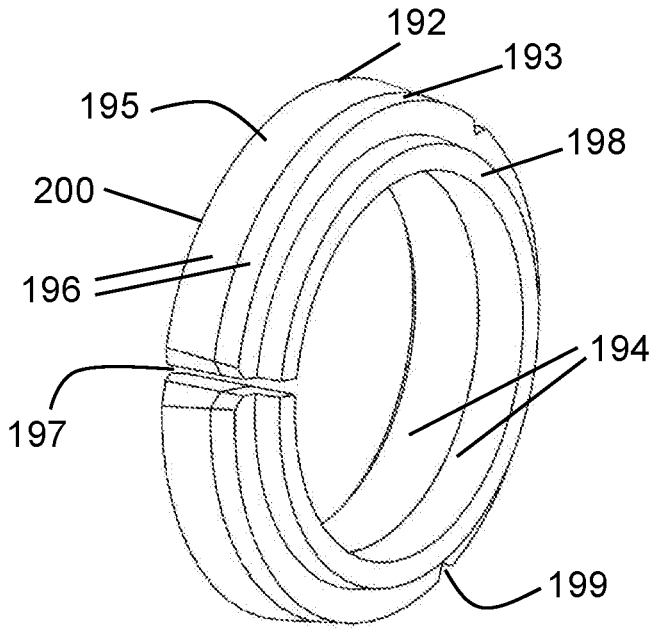
FIG. 9 is a perspective view of stiffness member used with a bat having the internal bat structure shown in FIGS. 6-8.
Figure 10:
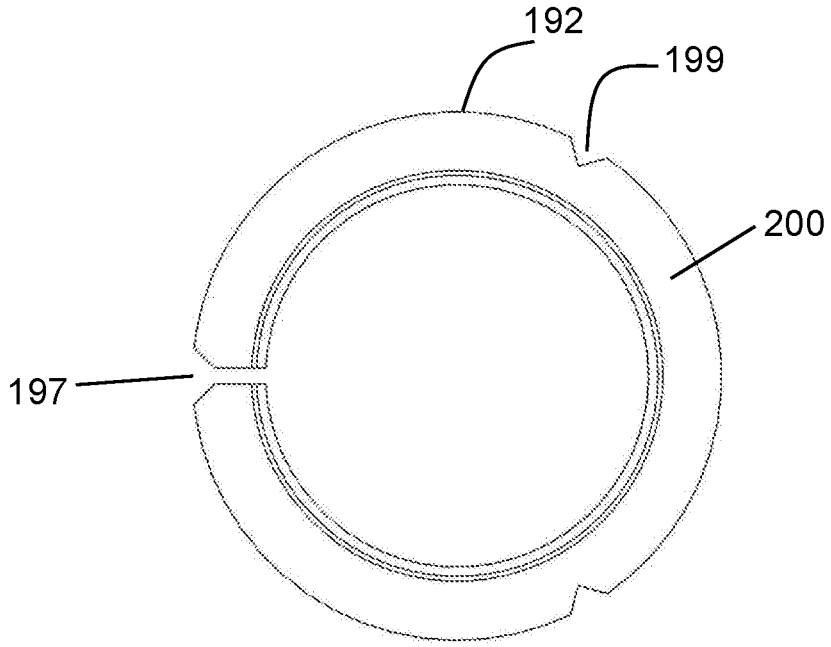
FIG. 10 is an end view of stiffness member of FIG. 9 looking toward at its barrel engaging end.

With the possible exception of a longer length from handle barrel end 26 to handle knob end 24 (FIG. 1), handle 20 with handle barrel end 26 shown in FIGS. 6-8 is the same handle 20 as appears in FIGS. 2-4. However, barrel 130, with barrel interior surface 131, barrel tapered portion 136, barrel handle end 138, and barrel joint receiving portion 139, shown in FIGS. 6-8 differs from barrel 30 shown in FIGS. 2-4 in that the barrel handle end 138 differs from barrel handle end 38. In FIGS. 2-4, barrel handle end 38 is generally transverse to or perpendicular to handle 20. In contrast, in FIGS. 6-8, barrel handle end 138 angles inward such that the barrel 130 side of gap 144 is wider at the variable stiffness assembly 150 than at the exterior of barrel 130. As is explained later, this inward angling helps to retain a selected stiffness member 192 in proper position. This inward angling is shown best in FIG. 7. Without limitation, an inward angle of between 5° and 45° from transverse helps retention without compromising the durability of the barrel handle end 138.

With continued reference to FIGS. 6-8, variable stiffness assembly 150, with interface portion 152, interface portion uniform inside diameter portion 154, interface portion stiffness member receiving portion 155, interface portion first stop 156, interface portion second stop 158, interface portion joint receptacle 159, interface portion coupling portion 160; interface portion handle end 162, and interface portion barrel end 164, differs from variable stiffness assembly 150 of FIGS. 2-4. The length of the portion of interface portion 152 between the interface portion barrel end 164 and the first stop 156 (FIGS. 6-8) is less than that for the length between end 64 and first stop 56 (FIGS. 2-4).

Also, wedge 166, with wedge exterior surface 167, wedge end cap end 168, wedge interior surface 169, and wedge knob end 170 of FIGS. 6-8 differs from wedge 66 of FIGS. 2-4. This changed shape of wedge 166 in FIGS. 6-8 requires that interface portion 152, with its coupling portion 160 oriented toward the handle knob end 24, being inserted over and glued on to handle 20 toward the handle barrel end 26, is positioned further from the handle barrel end 26 than for interface portion 52 of FIGS. 2-4. As such, handle barrel end 26 of FIGS. 6-8 is received further into barrel 130 than handle barrel end 26 of FIGS. 2-4 is received into barrel 30. Hence the comment above that the handle 20 used in the embodiment of FIGS. 6-8 may be longer than the handle 20 used with the embodiment of FIGS. 2-4 so as to form bats having the same length. As is seen in FIGS. 6-8, from closest to barrel handle end 138 to furthest therefrom, wedge 166 first has a wedge portion abutting interface portion on the wedge interior surface and barrel on the wedge exterior surface 171, then a wedge portion abutting handle on wedge interior surface and barrel on wedge exterior surface 172, and then a wedge portion abutting handle on wedge interior surface but not abutting barrel 173. In assembly, wedge 166 preferably has glue on its interior surface 169 and is glued to the interface portion 152 and handle 20 along wedge portions 171, 172, and 173. When inserted into barrel 130, wedge exterior surface 167 preferably has glue placed thereon at wedge portions 171 and 172 and those portions engage barrel interior surface 131. Wedge portion 173 does not engage the barrel interior surface 131. This wedge 166 and this second embodiment of FIGS. 6-10 are believed by the inventors to be the best mode, as this construction provides wedge 166 with additional surface area to engage interface portion 152 and handle 20 while still allowing the wedge 166 to provide a dampening effect. Even further, the inventors believe that this construction provides wedge 166 with additional thickness between wedge interior surface 169 and wedge exterior surface 167 allowing for an enhanced dampening effect. Also, by having the extended wedge portion 173 which does not contact the barrel interior surface 131, as the bat is used, the interface of the wedge 166 with the barrel interior surface 131 at the intersection of wedge portions 172 and 173 can provide better durability in use. As with wedge 66, wedge 166 is preferably made of EPDM rubber with a preferable hardness of about 45 Shore A, although different materials and hardness can be used in other implementations.

The joint 74 and o-ring 78 are the same in both the embodiments of FIGS. 2-4 and 6-8.

The cap 180, with cap exterior surface with raised ribs 181, cap barrel end 182, cap notched portion 184, cap coupling portion 186, cap knob end 188, cap o-ring channel 190, and decorative band 191, in FIGS. 6-8 differs from cap 80 of FIGS. 2-4. Plus the engagement of cap coupling portion 186 and interface portion coupling portion 160, shown as a threaded coupling, differ from the engagement of coupling portions 86 and 60 of the first embodiment. In FIG. 3, coupling portions 86 and 60 permit cap 80 to be coupled so that barrel end 82 of cap 80 can engage barrel handle end 38. In contrast, with reference to FIG. 7, cap 180 is threaded as far as the threaded portions permit, leaving gap 144 between barrel end 182 of cap 180 and barrel handle end 138. The inventors also believe that this construction of the second embodiment is better than that of the first embodiment, in that, with barrels made of some materials, with extended use, barrel end 38 can wear with end 38 being in contact with barrel end 82 of cap 80.

With reference now to FIGS. 6-10, stiffness member 192 differs from stiffness member 92 of the first embodiment, both in shape and construction. As to the first embodiment, stiffness member 92 was preferably of a single durometer as selected by the user. In one implementation, the user can be provided with a set of two or more stiffness members of varying hardnesses, and the user can select one of the set of stiffness members for use. This stiffness member 92 was inserted into stiffness member receiving portion 55 and cap 80 coupled so that stiffness member 92 was held in place by the notch portion insert 98 being received into notched portion 84 of cap 80 along with cap 80 holding the stiffness member 92 against barrel handle end 38. With this second embodiment of FIGS. 6-10, stiffness member 192 includes a harder durometer portion 193, stiffness member larger thickness interior portion 194, softer durometer portion 195, stiffness member small thickness exterior portion 196, slit 197, stiffness member notch portion insert 198, notch 199, and barrel engaging end 200. Hence, stiffness member 192 is of dual durometer construction, unless the user selects a member 192 where the portions 193 and 193 are of the same hardness. Most preferably, without limitation, harder durometer portion 193 has a hardness of 90 Shore A, and softer durometer portion 195 can have a hardness, for example, of 30, or 60, or 90 Shore A. Clearly, other hardnesses, or combinations of hardnesses, for both portions 193 and 195 can be selected. In the first embodiment, stiffness member 92 was shown without a slit, thereby being stretched over the outside of the bat for insertion into portion 55. With this stiffness member 192 of the second embodiment having the harder durometer portion 193, stiffness member 192 preferably includes slit 197 therethrough. With slit 197 and notches 199, rather than stretching stiffness member 192 for insertion into portion 155, the stiffness member 192 can be spread apart and inserted into portion 155. It is noted that, if desired, member 92 of the first embodiment could also include a slit with or without notches, which could be desirable with member 92 of a harder durometer. With reference to FIGS. 6-10, and as seen in FIG. 6, stiffness member 192 has been inserted into stiffness member receiving portion 155 and cap 180 threadably tightened so that stiffness member 192 is held in place by the notch portion insert 198 being received into notched portion 184 of cap 180 along with cap 180 holding the stiffness member 92 against barrel handle end 138 with end 138's inward angle providing additional mechanical locking of stiffness member 192 within gap 144.

Figure 12:
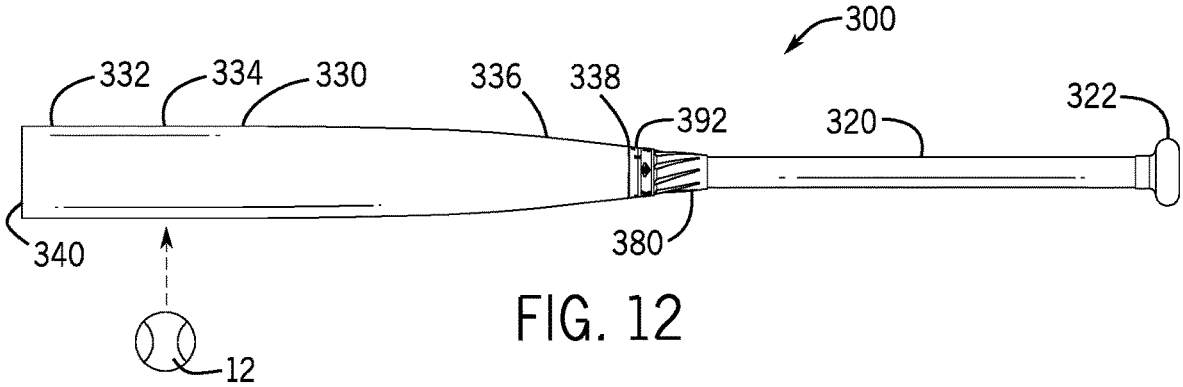
FIG. 12 is an external perspective view of another implementation of a variable stiffness ball bat of the present invention.
Figure 13:
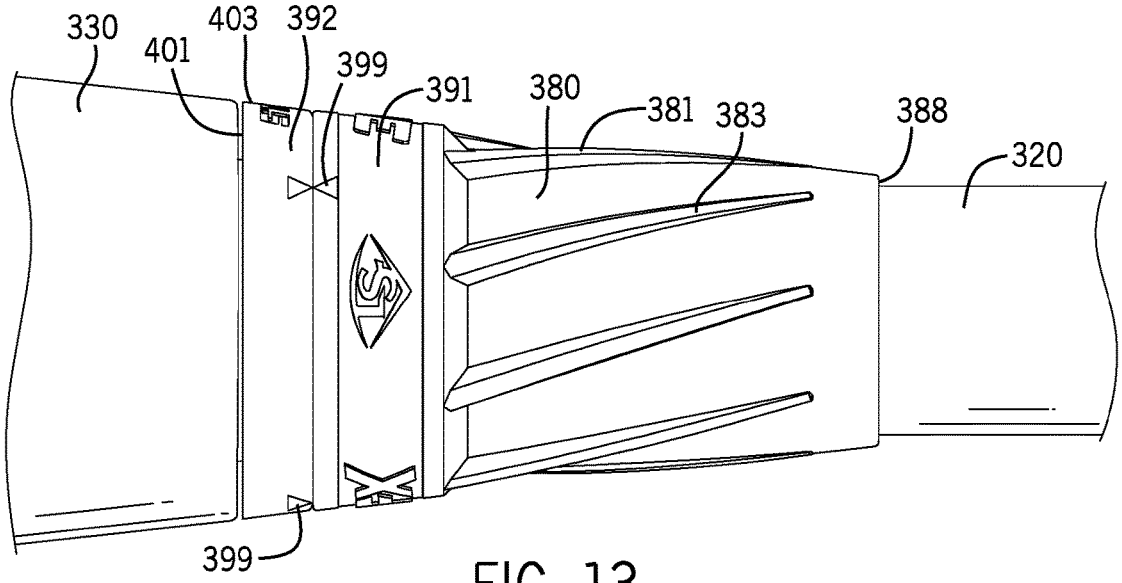
FIG. 13 is an external perspective view of a portion the ball bat of FIG. 12 showing a portion of the handle and barrel with the cap and stiffness member.
Figure 14:
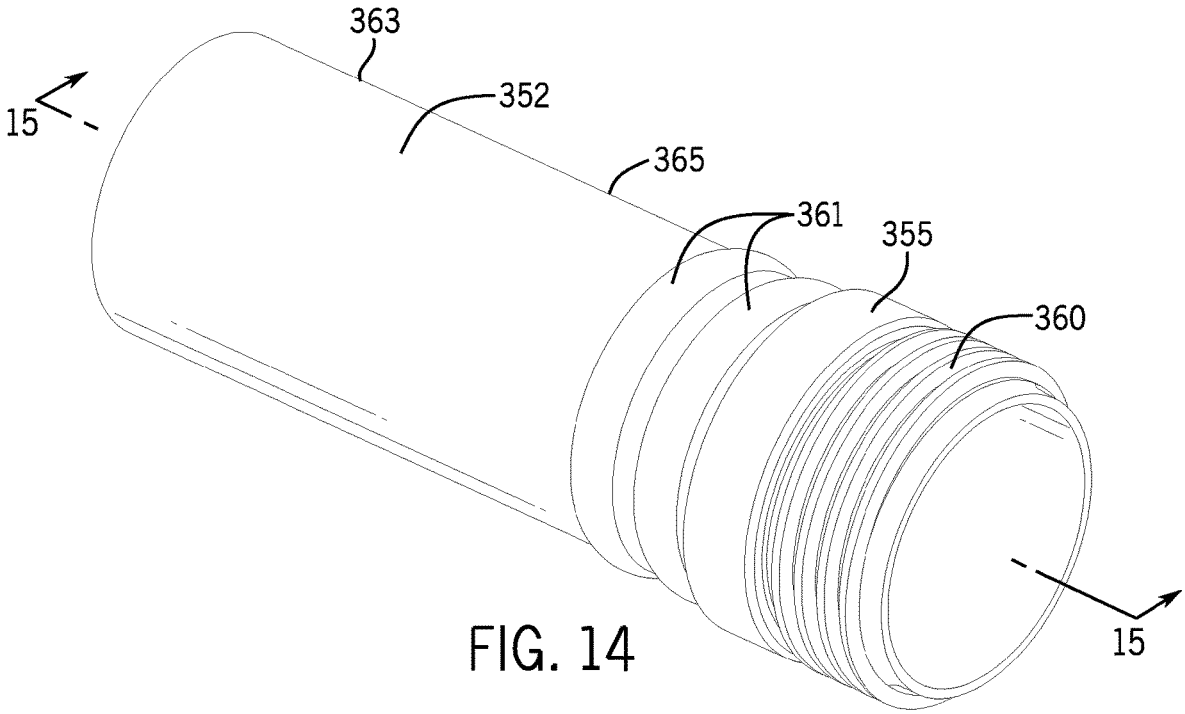
FIG. 14 is an external perspective view of an interface portion of the ball bat of FIG. 12.
Figure 15:
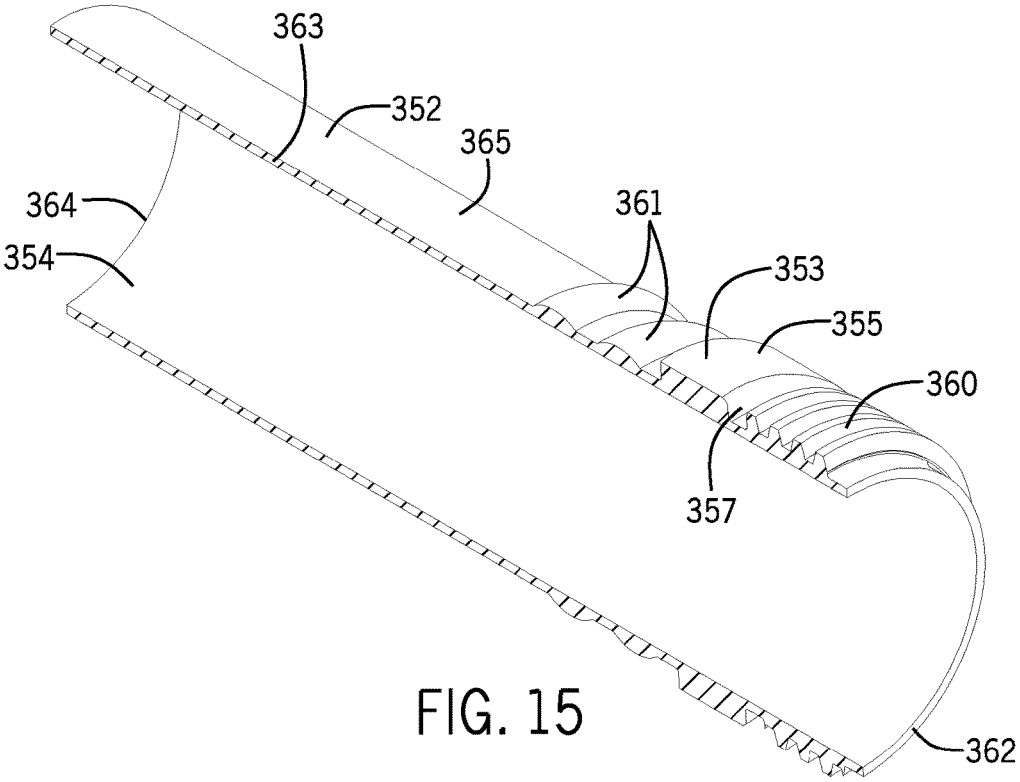
FIG. 15 is a cross-section view of the interface portion of FIG. 14.
Figure 16:
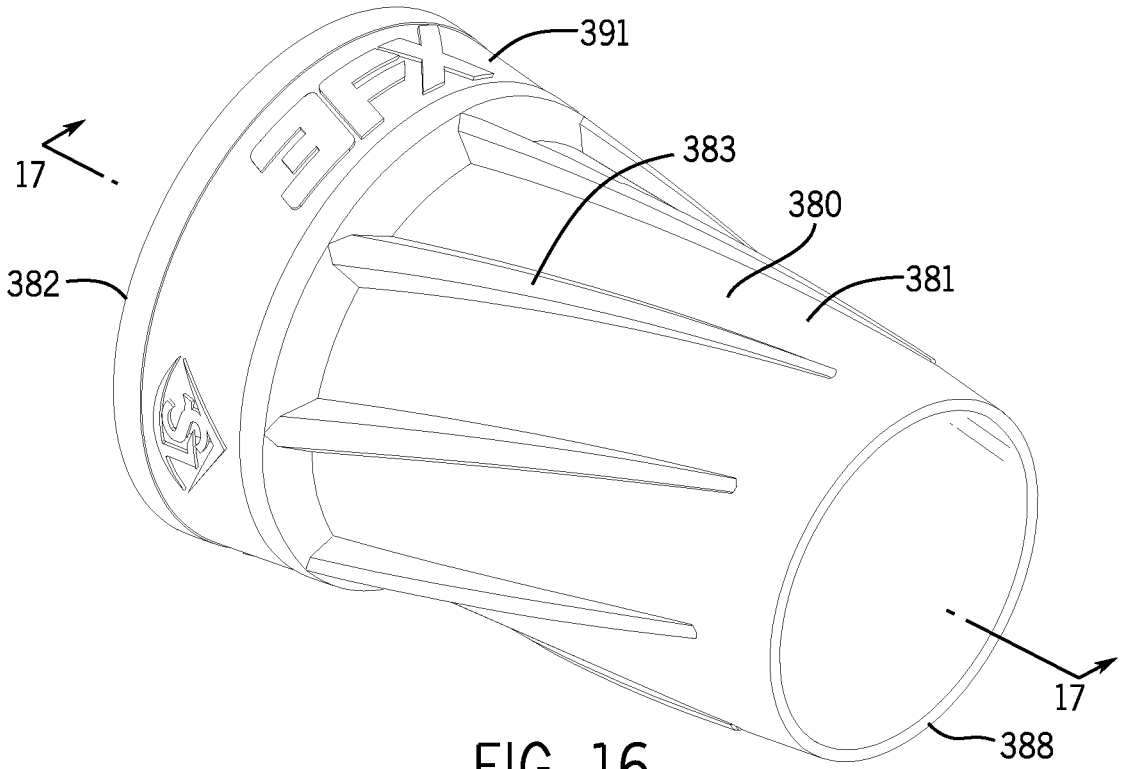
FIG. 16 is an external perspective view of the cap of FIG. 12.
Figure 17:
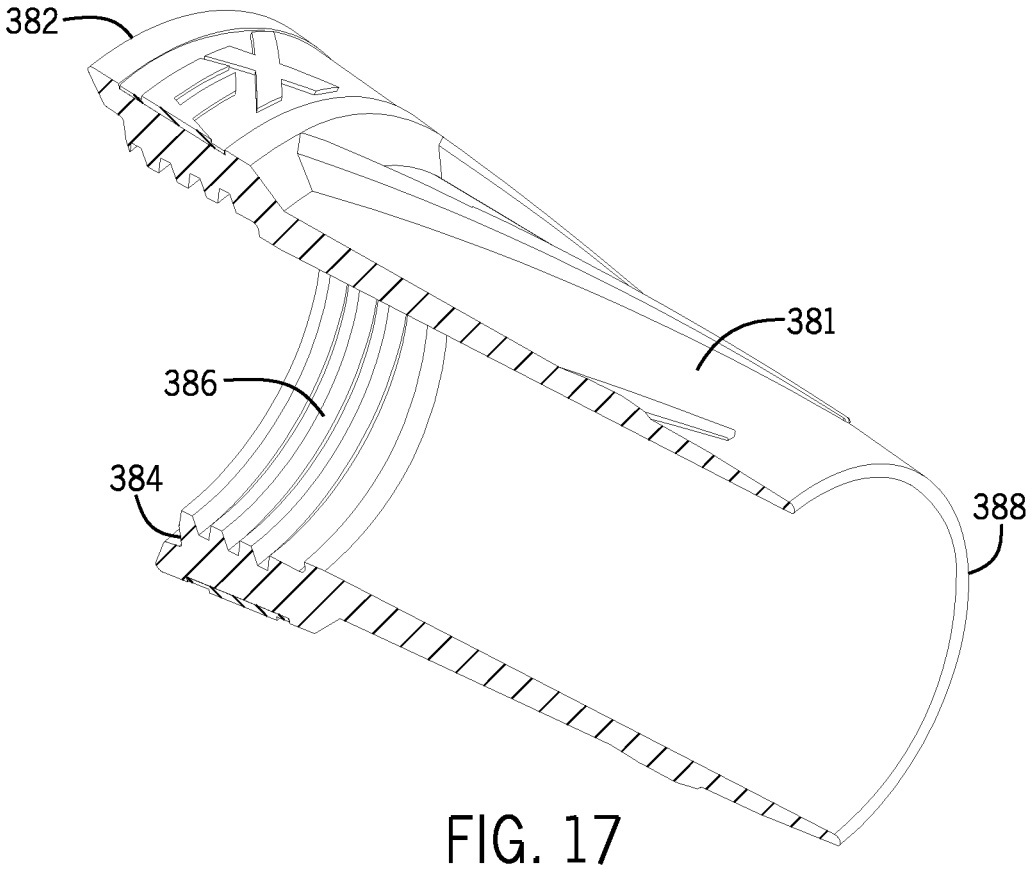
FIG. 17 is a cross-section view of the cap of FIG. 16.
Figure 18:
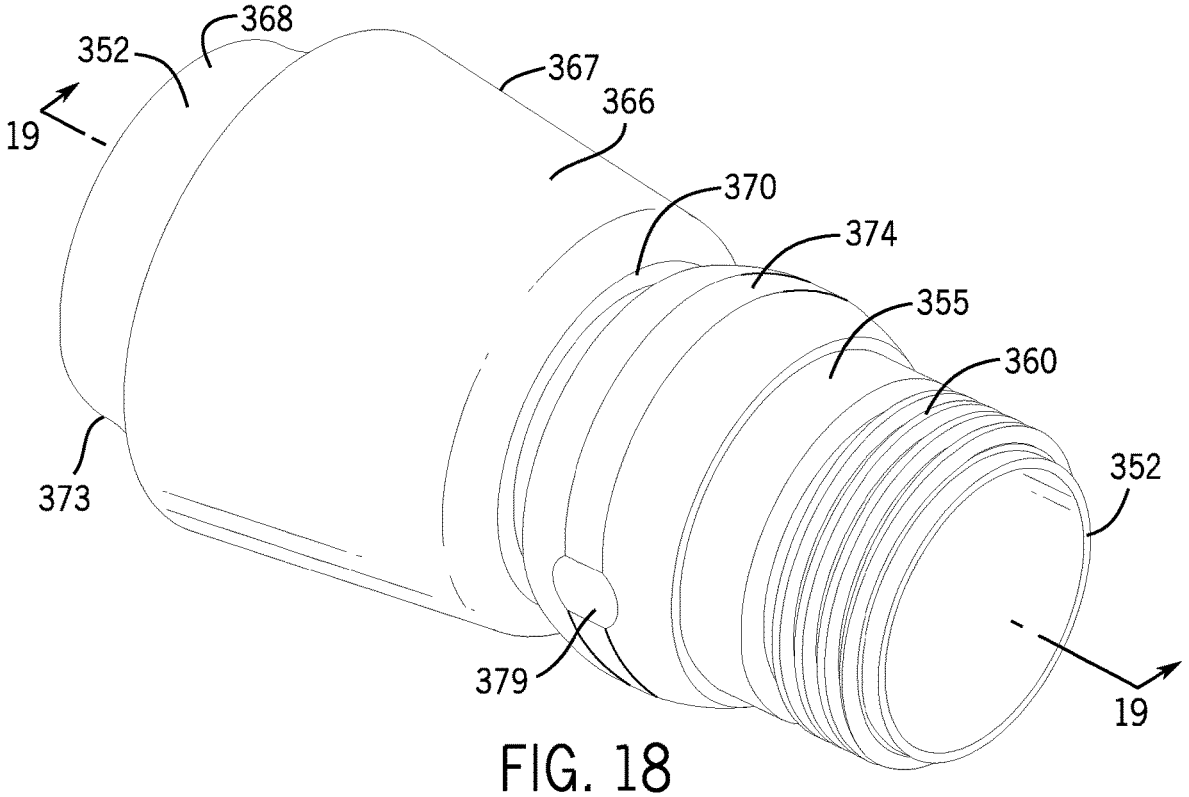
FIG. 18 is an external perspective view of the interface portion of FIG. 14, the interface portion having a wedge and joint therearound.
Figure 19:
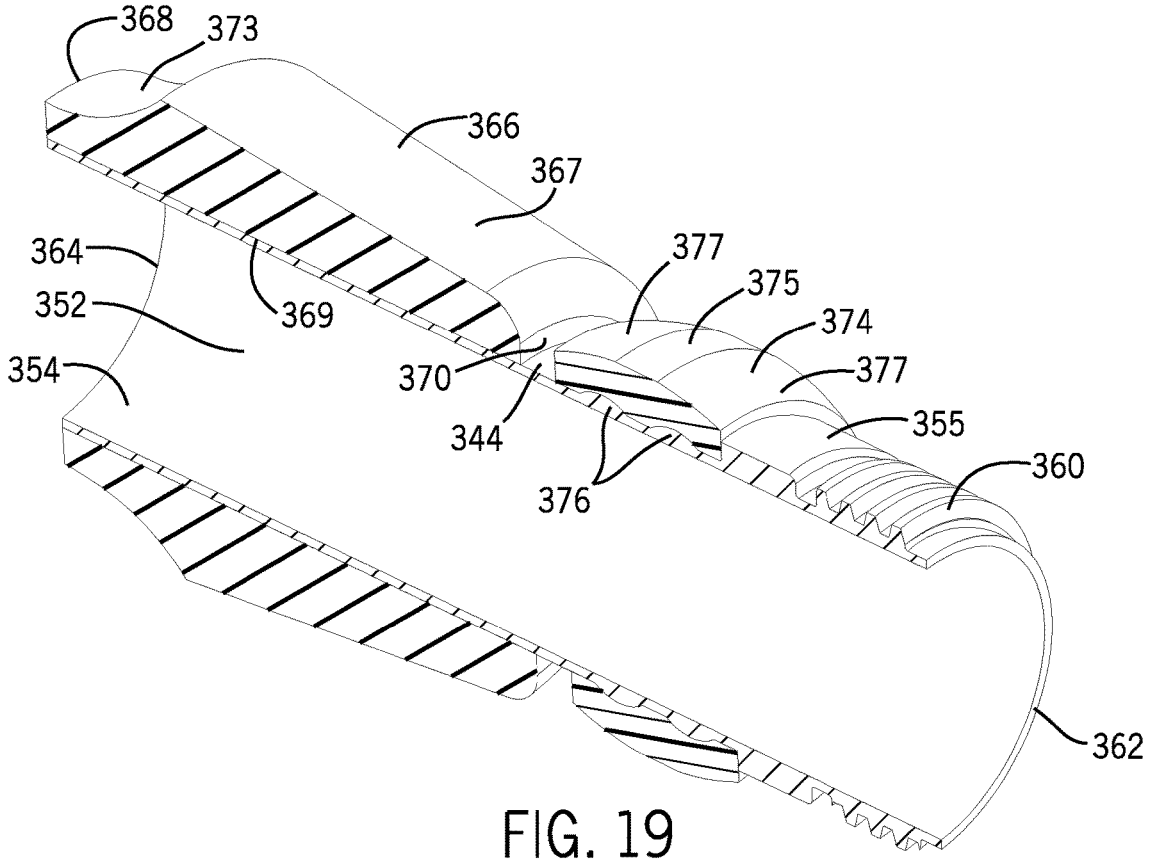
FIG. 19 is a cross-section view of the interface portion with wedge and joint therearound of FIG. 18.
Figure 20:
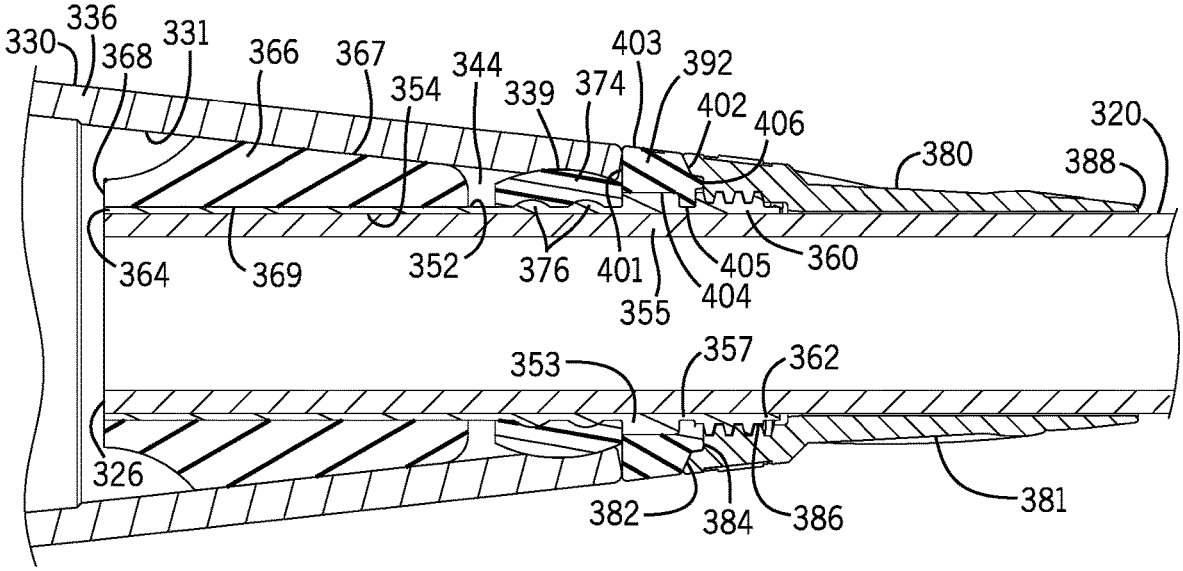
FIG. 20 is a cross-section view of the ball bat portion shown in FIG. 13.

With reference now to FIGS. 12-20, FIG. 12 is an external perspective view of another implementation of a variable stiffness ball bat 300 of the present invention. FIG. 13 is an external perspective view of a portion the ball bat 300 of FIG. 12 showing a portion of the handle 320 and barrel 330 with the cap 380 and stiffness member 392. FIG. 14 is an external perspective view of the interface portion 352 of FIG. 12. FIG. 15 is a cross-section view of the interface portion 352 of FIG. 14. FIG. 16 is an external perspective view of the cap 380 of FIG. 12. FIG. 17 is a cross-section view of the cap 380 of FIG. 16. FIG. 18 is an external perspective view of the interface portion 352 of FIG. 14, the interface portion 352 having a wedge 366 and joint 374 therearound. FIG. 19 is a cross-section view of the interface portion 352 with wedge 366 and joint 374 therearound of FIG. 18. FIG. 20 is a cross-section view of the ball bat 200 portion shown in FIG. 13.

The bat 300 embodiment shown in FIGS. 12-20 has manufacturing advantages which result in more consistent and reliable manufacturing. With particular reference to FIGS. 12 and 13, the exterior of bat 300 is shown having a handle 320 with a knob end 324 and a barrel end 326. Ball 12 is also shown. In one implementation, the knob 322 is molded or formed with the handle 320. In another implementation, the knob 322 can be attached to the handle 320 after the handle 320 has been formed. At the opposite end of the bat 300 from handle 320 is barrel 330. Barrel 330 has an end cap end 332, a generally uniform outside diameter portion 334, a tapered portion 336, and a handle end 338. Bat 300 also contains end cap 340. Bat 300 is shown with cap 380 and stiffness member 392 between the portions of the barrel 330 and handle 320 shown. This interface will be explained further in detail.

While other figures show the interface portion 352, it is shown in detail in FIGS. 14 and 15. Interface portion 352 includes a uniform inside diameter portion 354 and an outer surface 363, along with a handle end 362 and a barrel end 364. From the handle end 362 toward the barrel end 364, there is coupling portion 360 which will engage with a cap 380 as is explained later. As shown, coupling portion 360 is a threaded portion and the threads will receive the threads of a threaded portion in the cap. While this is the preferred structure, the threads can be eliminated and other fastening means can be employed. Examples, without limitation, are adhesive bonding, thermal bonding, chemical bonding, locking pins, other conventional fasteners, bayonet type fasteners, snap-fit connections, tongue and groove connections, interference fits, and combinations thereof. Moving toward the barrel end 364, after the coupling portion 360, there is a stiffness member receiving portion 355, which preferably includes notched portion 357 and inner flat surface receiving portion 353. Moving on toward the barrel end 364, are a pair of joint receiving ridges 361, which, as is explained later, mesh with corresponding channels in a socket joint and help prevent longitudinal movement of the joint along the interface portion 352, the ridges 361 functioning as an interface portion joint receptacle. Moving on toward the barrel end 364, is the wedge receiving portion 365. Interface portion 352 can be formed of aluminum, nylon, or another rigid and durable material.

With particular reference to FIGS. 14-15 and 18-19, interface portion 352 is a rigid, durable cylindrical body that is generally more elongated than in earlier embodiments. This permits the wedge 366 and the joint or socket joint 374 to be injection molded and/or compound molded to the interface portion outer surface 363, so that interface portion 352 with wedge 366 and joint 374 molded therearound can be prepared as a separate assembly shown particularly in FIG. 18 to be used in subsequent bat manufacture. Gap or longitudinal spacing 344 between wedge 366 and joint 374 allows space for the injection molding tooling to be positioned about the interface portion 352. Because joint 374 and wedge 360 are molded to the interface portion 352, they are continuous annular members and do not need slits or gaps so that they can be manually inserted onto the interface portion. Although in one implementation, as mentioned above, the wedge 366 and the joint 374 can be molded to, and compound molded to, the interface portion 352, respectively, in other implementations, the wedge and/or the joint 374 can be coupled to the interface portion though other means such as bonding, thermal bonding, chemical bonding, adhesives, overmolding and combinations thereof, and can be formed with or without a slit or a gap.

In one implementation, as shown in FIG. 19, joint 374 has an outer central portion 375 on its exterior surface between a pair of spaced apart curved barrel engaging surfaces 377. The outer central portion 375 is generally flattened reducing thickness or outer diameter of the joint 374 and also reducing the weight of the joint 374. In other implementations, the outer central portion 375 can take other shapes, widths and/or profiles. In still other implementations, the central portion 375 can be eliminated and the outer surface of the joint 374 can have a continuous curved surface for engaging the barrel 330. The barrel engaging surfaces 377 correspond to the shape and/or contour of the barrel joint receiving portion 339. The size and/or outer diameter of socket joint 374 (and the barrel joint receiving portion 339) can be generally increased so as to provide an increased radius of curvature which increases the surface area contacting the corresponding barrel joint receiving portion 339. The curved barrel engaging surfaces 377 provide for and enable the pivotal movement of the joint 374 (or socket) with the barrel joint receiving portion 339 of the barrel 330 upon impact of the barrel 330 with a ball 12 (see FIG. 12). When joint 374 is molded to the interface portion 352 over the joint receiving ridges 361, joint 374 has a pair of corresponding channels 376 created. The engagement of the joint receiving ridges 361 of the interface portion 352 and the channels 376 of the joint 374 inhibit longitudinal movement of the joint 374 with respect to the interface portion 352 and the handle 320 of the bat 300. In other implementations, the size, shape, height, and/or width of the joint receiving ridges 361 can be varied. In other implementations, the number of joint receiving ridges 361 can be varied. For example, the interface portion 352 can be formed with one, three, four or more ridges 361 and the inner surface of the joint 374 can be formed with a corresponding number of channels 376. In another implementation, the ridges of the interface portion engaging corresponding channels of the inner surface of the joint can be replaced with an annular ridge positioned on the end cap end of the joint so as to inhibit longitudinal movement of the joint with respect to the interface portion in the direction of the end cap, similar to the first stop 156 of FIG. 6.

In one implementation, the joint 374 is injection molded and may include a recessed region 379 to accommodate the injection molding operation. The recessed region 379 facilitates the injection molding of the joint 374 by preventing the occurrence of a raised projection or projections resulting from the injection molding process of forming the joint 374. Additionally, because the joint 374 can be injection molded about the interface portion 352, the joint 374 takes a complete annular shape without slits or cuts about its periphery. In other implementations, the joint 374 may be formed separately from the interface member and can include a slit or cut to enable the joint 374 to be positioned over the interface portion and then resiliently engaging the interface portion at the desired location.

In one implementation, the joint 374 is formed of a durable, rigid material, such as a nylon. In other implementations, the joint can be formed of other materials, such as, for example, a fiber reinforced nylon, a polycarbonate, a high strength acetal homopolymer such as Delrin®, other polymeric materials, acrylonitrile butadiene styrene (ABS), ceramic, aluminum, other alloys or combinations thereof.

Wedge 366 is shown in cross-section in FIG. 20, but also see FIGS. 17-18. Wedge 366 a cylindrical, cone shaped body formed of a resilient elastomeric material, such as ethylene propylene diene monomer (EPDM). In other implementations, the wedge can be formed of other synthetic rubbers, natural rubber, a polymeric foam, other elastomeric materials, and combinations thereof. The wedge 366 and the stiffness member 392 resist pivotal movement of the barrel 330 with respect to the cap 380 and the handle 320 about the joint 374. The wedge 366 can be formed of one or more resilient materials having a hardness or durometer value within the range of 20 on the Shore A scale to 80 on a Shore D scale. In other implementations, the wedge 366 can be formed of one or more resilient materials have a hardness or durometer value within the range of 30 to 80 on a Shore A scale. Wedge 366 has an exterior surface 367 and interior surface 369, an end cap end 368, a knob end 370, and a tapered portion 373 results in the wedge tapering toward the wedge end cap end 368 and this increases the durability and flexibility of the wedge.

The tapered or frustoconical shape of the outer surface 367 of the wedge 366 is shaped and contoured to correspond to the inner surface of the barrel tapered portion 336 of the barrel 330. The inner surface 369 of the wedge 366 is fixedly secured to the outer surface of the handle 320 and the outer surface 367 of the wedge 366 is fixedly secured to the inner surface of the barrel tapered portion 336 such that when the bat barrel 330 pivots about the joint 374 with respect to the handle 320 upon impacting a ball, the resilient wedge 366 biases the pivoting movement of the barrel 330 with respect to the handle 320 and urges the barrel 330 back into alignment with the handle 320. Accordingly, the wedge 366 provides a bias or spring force that allows for the flexing of the barrel 330 with respect to the handle 320 upon impact with a ball and then resiliently returns the barrel 330 to be in co-axial alignment with the handle 320. As such, wedge 366 can serve as a first biasing element. The resilient nature of the material of the wedge 366 and its connection to the handle 320 and the barrel 330 also allows for a small amount of rotational or torsional deflection of the barrel 330 with respect to the handle 320 upon application of a torsional load.

Cap 380 is shown in several figures, but particularly in FIGS. 16-17. Cap 380 is shown with an exterior surface 381, a barrel end 382, and a knob end 388. In one implementation, a plurality of ridges 383 can be formed on the exterior surface 381 to facilitate tightening and loosening of the cap 380 onto interface portion 352. In one particular implementation, the cap 380 includes a coupling portion 386 that threadedly engages the coupling portion 360 of the interface portion 352.

Cap 380 can also include a decorative band 391 therearound. Also, on the cap 380 interior toward the barrel end 382 is a notched portion 384 which, as will be explained later, engages a portion of the stiffness member 392. Cap 380, or an outer collar, can be formed of a hard plastic material or other, strong, durable material, such as, for example, aluminum or other alloy.

Referring to FIG. 13, in one implementation, the outer surface of the decorative band 391 of the cap 380 and the outer surface of the stiffness member 392 may include indicia 399 indicating the relative position of the cap 380 to the stiffness element 392. When the indicia 399 are aligned in a first position, a first stiffness value of the assembly of the cap 380 and the stiffness member 392 may result. When the cap 380 is rotated to align the indicia in other positions, other stiffness values of the assembly of the cap 380 and the stiffness member 392 may result. The indicia 399 is shown in the form of triangles. In other implementations, the indicia may take other forms, including other graphical and/or alphanumeric indicia.

Stiffness member 392 is shown in cross-section in FIG. 20. Stiffness member 392 engages barrel 330, joint 374, interface portion 352, and cap 380. It is designed geometrically with barrel engaging end 401 which engages the barrel handle end 338 and joint 374, cap engaging end 402 and cap notched portion tab 406 which engages the cap barrel end 382 and cap notched portion 384, inner flat surface 404 which engages interface portion inner flat surface receiving portion 353, and tab 405 which engages interface portion notched portion 357. Stiffness member 392 also has exterior surface 403.

It is noted that when the bat barrel 330 pivots about the joint 374 with respect to the handle 320 upon impacting a ball, both the resilient wedge 366 and the stiffness member 392 bias the pivoting movement of the barrel 330 with respect to the handle 320 and urge the barrel 330 back into alignment with the handle 320. Accordingly, the wedge 366 and stiffness member 392 provide a bias or spring force that allows for the flexing of the barrel 330 with respect to the handle 320 upon impact with a ball and then resiliently returns the barrel 330 to be in co-axial alignment with the handle 320. As such, wedge 366 can serve as a first biasing element and stiffness member 392 can serve as a second biasing element.

In other implementations, other geometries of the stiffness member and the components it interfaces with can be used. For example, the interface between the cap barrel end and the stiffness member may form a linear or angle engagement surfaces. In other examples, the interface may be curved, angled or take other shapes. However, in many preferred implementations, the cap 380 is angled or otherwise configured so as to extend over a portion of the stiffness member 392, so that, as the cap 380 is drawn closer to the barrel 330, the stiffness member 392 is prevented or deterred from bulging outward. The stiffness member 392 is formed of a resilient elastomeric material, such as silicone. In other implementations, the stiffness member can be formed of a synthetic rubber, a natural rubber, a polymeric foam, other elastomeric materials, EPDM, and combinations thereof.

Figure 21A:
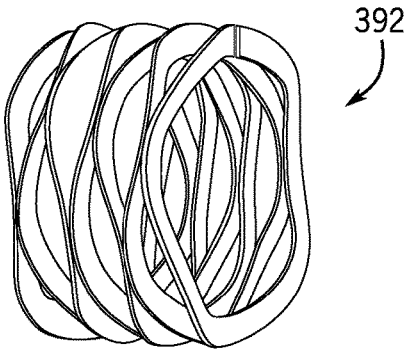
FIGS. 21A and 21B are side perspective views of a wave washer in accordance with an alternative implementations of the present invention.
Figure 21B:
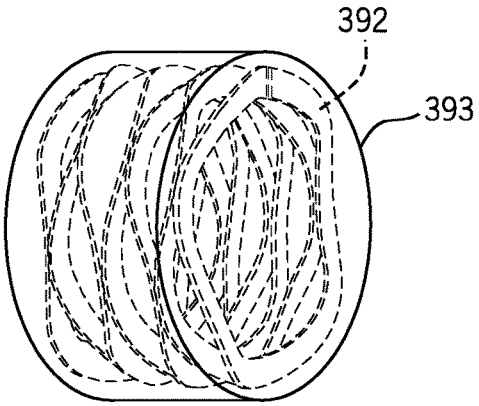

As shown in FIG. 21A, in another implementation, the stiffness member 392 can be a wave washer or a wave spring that can be used to adjust the stiffness as the cap is tightened. The stiffness member 392 can be formed of a metal or other material. Further, in another implementation, as shown in FIG. 21B, the stiffness element 392 may be encased in an elastomeric material or a flexible housing 393 to prevent moisture, dirt or other debris from entering the stiffness member 392.

In one preferred method of making of bat 300 of FIGS. 12-20, the assembly of interface portion 352, wedge 366, and joint 374 is first formed by injection molding and/or compound molding the wedge 366 and the joint 374 to the interface portion. The uncured handle layup is then inserted longitudinally through the interface portion uniform inside diameter portion 354 and the fiber composite handle 320 is molded and cured with the interface portion 352, wedge 366 and joint 374. This molding provides a very strong connection between the handle and the interface portion 352. The barrel 330 is formed as a separate component, either as a pre-molded and cured fiber composite barrel or as a barrel formed of an aluminum alloy or other alloy. An adhesive is applied to the outer surface 367 of the wedge 366, and the proximal or grip end of the molded handle 320 along with the assembly of the interface portion 352, the wedge 366 and the joint 374 are then inserted into the barrel end cap end 332 of the barrel 330. The proximal end of the handle 320 is then drawn or pulled through the barrel handle end 338 until the wedge 366 and joint 374 engage the barrel tapered portion 336 and the barrel joint receiving portion 339, respectively. The stiffness member 392 and the cap 380 positioned over the handle 320 from the proximal end of the handle 320. The cap 380 is then threadedly engaged to the coupling portion 360 of the interface portion 352, where it can tightened and positioned in the desired threaded position. The knob 322 can then be secured to the proximal end of the handle 320.

Numerous other methods, steps or techniques of manufacturing one or more of the above described components may also be used and are contemplated under the present invention, including, for example, molding a fiber composite barrel with the handle and the interface portion/wedge and/or joint, snap-fitting the stiffness member about a preformed handle, barrel and cap assembly.

The bat 300 provides a player and/or purchaser with numerous customization options enabling a player, coach, parent or other purchaser to select a bat configuration that is optimized for a particular player and/or application. Bat 300 can be configured for the bat owner preferences and the purchaser can have a bat 300 manufactured to these preferences, selecting from various customizable options. For example, the hardness of the stiffness member 392 and the wedge 366 are owner selectable. For the stiffness member 392, it can be provided in any hardness range between 20 Shore A and 80 Shore D. As previously stated, the wedge 366 and the stiffness member 392 resist pivotal movement of the barrel 330 with respect to the cap 380 and the handle 320 about the joint 374. Alternatively, in one implementation, a player or purchaser can choose among 3 different hardnesses for the stiffness member 392 and/or the wedge 366; for example, 30 Shore A, 60 Shore A, or 90 Shore A for the stiffness member and 45 Shore A, 55 Shore A, 65 Shore A and 75 Shore A hardness or durometer values for the wedge 366. Bat purchasers could also be provided choices of between any number of hardnesses, such as 2, 3, 4, 5, 6, 7, etc. for each of these components.

In other implementations, the stiffness member may formed as a multi-layered structure. For example the stiffness member 392, instead of having being formed of a single material with a single durometer hardness, the stiffness member may have a dual durometer construction, such as taught with the embodiment of FIG. 9.

Figure 22A:
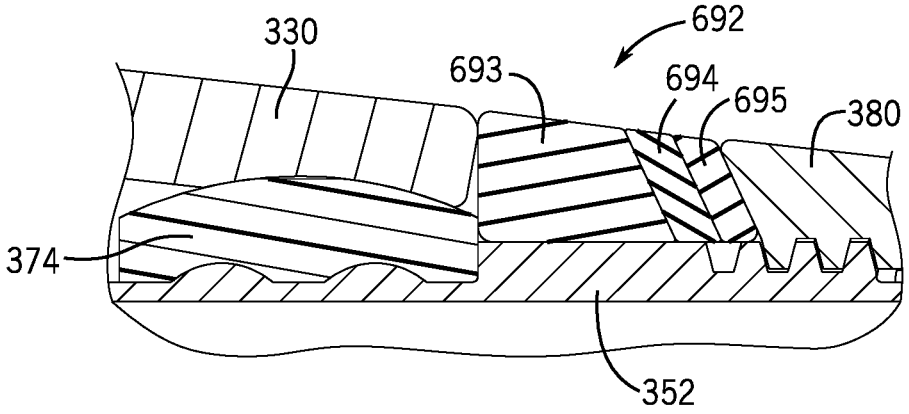
FIG. 22A is an enlarged cross-sectional view of a central portion of a ball bat in accordance with another implementation of the present invention.
Figure 22B:
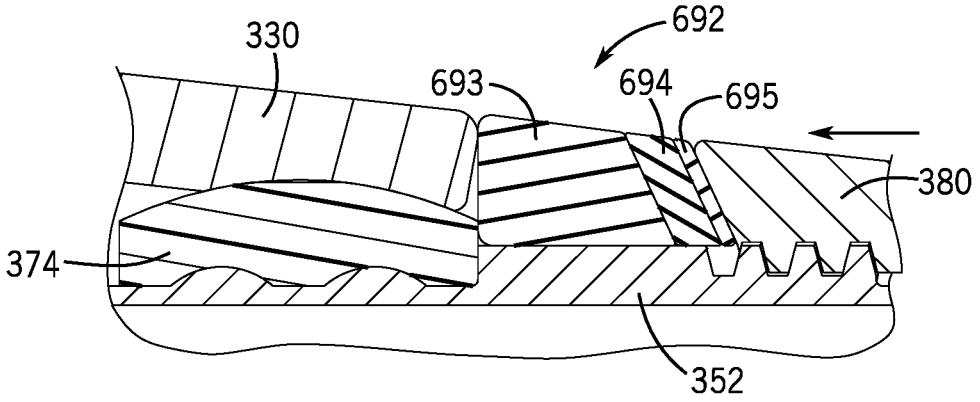
FIGS. 22B and 22C are enlarged cross-sectional views of a portion of a stiffness member of the ball bat of FIG. 22A in different compression positions.
Figure 22C:
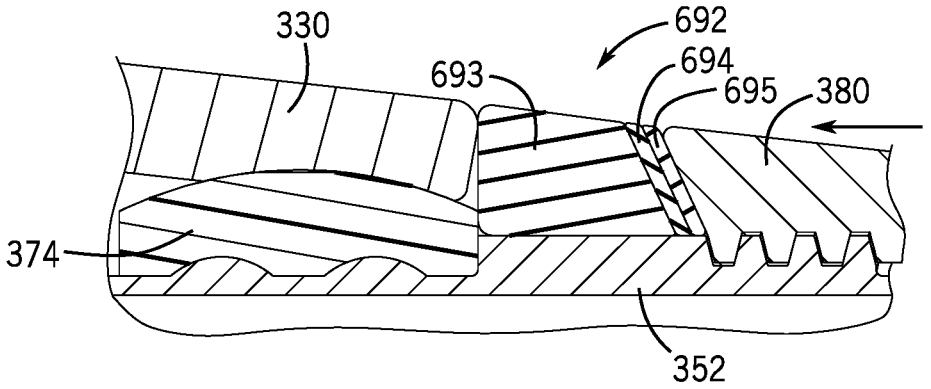
Figure 23:
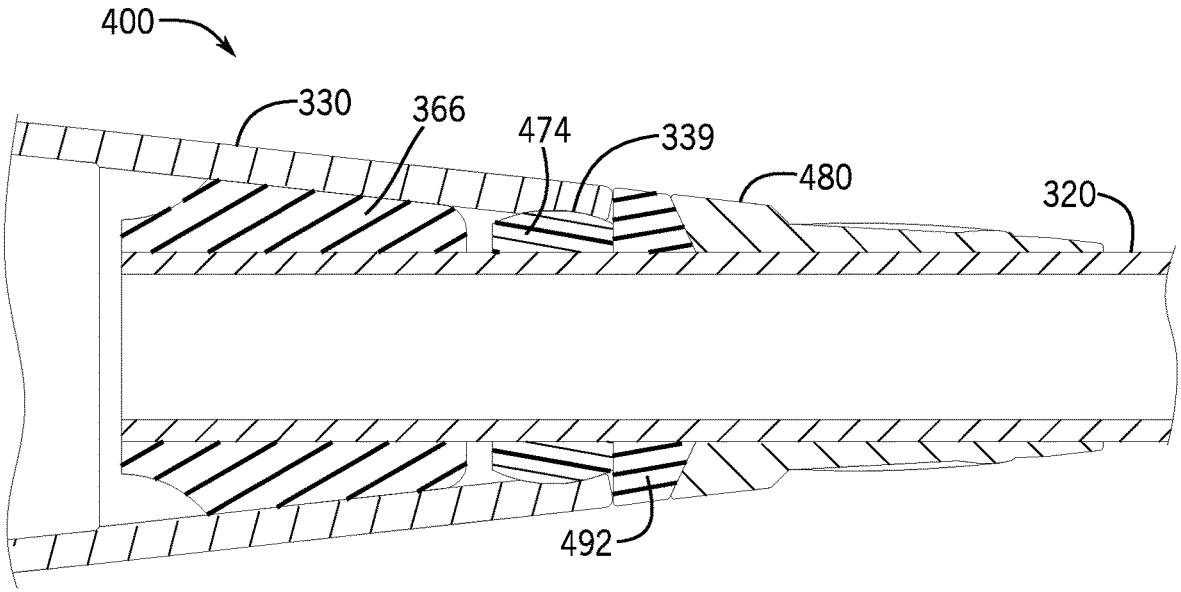
FIG. 23 is a longitudinal cross-sectional view of a central portion of a bat in accordance with another alternative implementation of the present invention.
Figure 24:
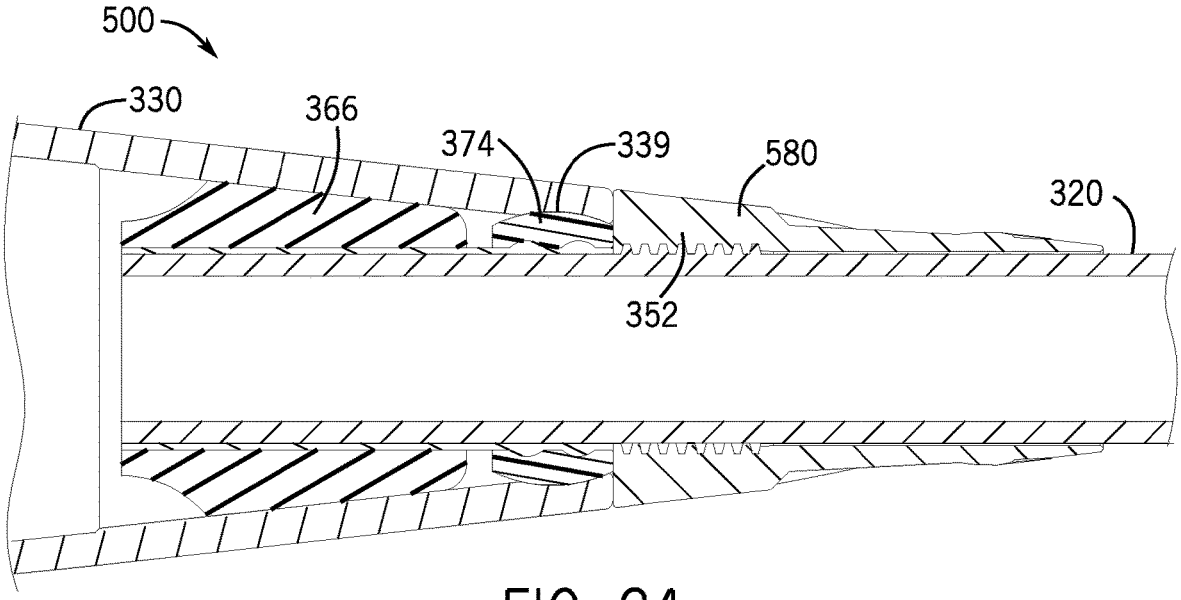
FIG. 24 is a longitudinal cross-sectional view of a central portion of a bat in accordance with another alternative implementation of the present invention.

With additional reference to FIGS. 21A-24, FIGS. 21A and 21B are side perspective views of a wave washer in accordance with an alternative implementations of the present invention; FIG. 22A is an enlarged cross-sectional view of a central portion of a ball bat in accordance with another implementation of the present invention; FIGS. 22B and 22C are enlarged cross-sectional views of a portion of a stiffness member of the ball bat of FIG. 22A in different compression positions; FIG. 23 is a longitudinal cross-sectional view of a central portion of a bat in accordance with another alternative implementation of the present invention; and, FIG. 24 is a longitudinal cross-sectional view of a central portion of a bat in accordance with another alternative implementation of the present invention.

In the implementation, shown in FIGS. 22A, 22B and 22C, a stiffness member 692 may be formed of three layers 693, 694 and 695 with each layer being formed of a material having a different hardness or durometer value. As shown in FIG. 22A, when the cap 380 is positioned in a first position, the cap 380 can just contact or engage the stiffness member 692 and layer 695. The result of such engagement may only slightly compress layer 695 or not compress layer 695 such that the assembly of the cap 380 and the stiffness member 692 result in a first hardness or stiffness value for the bat assembly of, for example, 30 on a Shore A scale. As cap 380 is tightened to a second position, as shown in FIG. 22B, the cap 380 may bear against stiffness member 692 such that layer 695 is fully compressed, and layers 693 and 694 may be only slightly compressed or not compressed at all. The result of the second position would be a second hardness or stiffness value of the assembly of the cap 380 and the stiffness member 692 that results in a second hardness or stiffness value for the bat assembly of, for example, 60 on a Shore A scale. As cap 380 is further tightened to a third position, as shown in FIG. 22C, the cap 380 may bear against stiffness member 692 such that layers 695 and 694 are fully compressed, and layer 693 may be only slightly compressed or not compressed at all. The result of the third position would be a third hardness or stiffness value of the assembly of the cap 380 and the stiffness member 692 that results in a third hardness or stiffness value for the bat assembly of, for example, 90 on a Shore A scale. In other implementations, the stiffness member can be configured to produce other hardness values including a different quantity of hardness value positions. As previously stated, the wedge 366 and the stiffness member 392 resist pivotal movement of the barrel 330 with respect to the cap 380 and the handle 320 about the joint 374.

Also, wedge 366 hardness can be user selectable from 20 Shore A to 80 Shore D. As part of the purchaser customization on ordering a bat, the purchaser may select other preferences, such as, for example, bat model, bat length, bat weight, bat graphics, etc.

Mechanical changes may also be possible which would change the bat hardness. For example, cap 380 may be adjustable to a selected group of threaded positions. With the cap 380 at a first stop position, the stiffness member might provide a hardness of 30 Shore A. As the cap 380 is tightened to a second stop position, the stiffness member 392 may be compressed so as to provide a hardness of 60 Shore A. Then, as the cap 380 is further tightened to a third stop position, the stiffness member may be further compressed to provide a hardness of 90 Shore A. In other implementations, the stops or positions of the cap 380 and the stiffness member 392 can be altered to provide different hardness values generally within the range of 20 Shore A hardness to 80 Shore D hardness. In other implementations, other numbers of stops can be provided if more hardness options are desired, such as 2, 4, 5, or more stops. The tightening or torqueing positions of the cap 380 with respect to the interface portion 352 can be denoted or otherwise indicated by adding markings or other forms of graphics and/or indicia to indicate the selected positions. In other implementations, notches, projections or other indexing structure may be employed to designate the multiple torqueing positions of the cap with respect to the interface portion 352.

Mentioned previously was that coupling portion 360 of interface portion 352 is a threaded portion and the threads will receive the threads of a threaded portion in coupling portion 386 of the cap 380. While this is the preferred structure, the threads can be eliminated and other fastening means can be employed. Examples, without limitation, are adhesive bonding, thermal bonding, chemical bonding, locking pins, other conventional fasteners, bayonet type fasteners, snap-fit connections, interference fits, and combinations thereof. The bat 300 has generally been described as one which is adjustable or as one where parts can be replaced. It is possible that organizations may not permit bat field adjustments. While less versatile, it makes the purchaser options even more important so that the purchaser get the desired bat. Some of the above optional fastening means, such as a locking adhesive, may be required so that the bat is not adjustable post manufacture.

Referring to FIG. 23, in another implementation, a bat 400 can be constructed substantially the same as the bat 300, except that the interface portion 352 is removed from the bat 400. In this implementation, a cap 480, a joint 474 and a stiffness member 492 all extend and connect to the handle 320 as opposed to an intermediate interface portion 352. The cap 480, the joint 474 and the stiffness member 492 are substantially similar to the cap 380, the joint 374 and the stiffness member 392 except they are attached directly to the handle 320 by one or more attachment methods, such as, for example, molding, adhesive, thermal bonding and combinations thereof.

Referring to FIG. 24, in another implementation, a bat 500 can be constructed substantially the same as the bat 300, except that the stiffness member 392 is removed from the bat 500. In this implementation, a cap 580 has a flatter and generally vertical barrel end that engages the barrel handle end 336 of the barrel 330 and the joint 374.

The foregoing detailed description is given primarily for clearness of understanding and no unnecessary limitations are to be understood therefrom for modifications can be made by those skilled in the art upon reading this disclosure and may be made without departing from the spirit of the invention.

What is claimed is:

1. A striking implement comprising:

a handle, the handle having a handle knob end and a handle barrel end, the handle having a wedge thereround toward the handle barrel end and a joint thereround closer to the handle knob end than the wedge;

a barrel, the barrel having a barrel end cap end and a barrel handle end and a barrel interior surface, the barrel having an internal joint receiving portion toward the barrel handle end;

the handle with the wedge and the joint thereround being partially received by the barrel, where the joint is received by the barrel joint receiving portion and where at least a portion of an outer wedge surface engages a portion of the barrel interior surface, the outer wedge surface engaging the barrel interior surface further from the barrel handle end than where the joint is received; and an interface portion, where the interface portion has the wedge and the joint thereround on an interface portion outer surface, and a portion of the handle is received in an interface portion uniform inside diameter portion.

2. The striking implement of claim 1, further comprising a stiffness member and a cap; the stiffness member having a barrel engaging end and a cap engaging end, the stiffness member received over the handle; the cap having a barrel end and a knob end, the cap received over the handle; where the cap secures the stiffness member so that the stiffness member barrel engaging end engages the barrel handle end and the stiffness member cap engaging end engages the cap barrel end.

3. The striking implement of claim 2, where the interface portion further includes at least one joint receiving ridge thereround, the joint being attached thereover, the joint having at least one channel corresponding to the at least one joint receiving ridge.

4. The striking implement of claim 3, where the wedge is molded around the interface portion.

5. The striking implement of claim 2, where the wedge has a portion toward the barrel end cap end which does not engage the barrel interior surface.

6. The striking implement of claim 2, where the interface portion includes an interface portion coupling portion toward an interface portion handle end, and where the cap has a coupling portion, the cap coupling portion and the interface portion coupling portion cooperating to secure the stiffness member.

7. The striking implement of claim 6, where the interface portion coupling member and the cap coupling member have cooperating threads.

8. The striking member of claim 7, where the cap can be adjusted to one or more positions in relation to the barrel handle end.

9. The striking implement of claim 7, where the cap is not adjustable.

10. The striking implement of claim 1, where the interface portion further includes at least one joint receiving ridge thereround, the joint being attached thereover, the joint having at least one channel corresponding to the at least one joint receiving ridge.

11. A striking implement assembly, comprising:

an interface portion, the interface portion having a uniform inside diameter portion and an outer surface, along with a handle end and a barrel end; where moving along the interface portion outer surface from the handle end toward the barrel end, the outer surface includes a coupling portion, a stiffness member receiving portion, at least one joint receiving ridge, and a wedge receiving portion; a joint being positioned around the interface portion outer surface, the joint having at least one channel corresponding to the at least one joint receiving ridge; and a wedge having a wedge end cap end and a wedge knob end and a wedge interior surface, the wedge being positioned around the interface portion outer surface such that the wedge interior surface engages the wedge receiving portion of the outer surface of the interface portion; and a composite handle, the handle having a barrel end and a knob end, the handle barrel end being inserted at least partways into the interface portion uniform inside diameter portion and molded therein.

12. A ball bat extending along a longitudinal axis and configured for impacting a ball, the bat comprising:

a barrel extending along the longitudinal axis and having a barrel end cap end region, a barrel handle end region and an interior surface;

a handle extending along the longitudinal axis and having a length, a handle knob end and a handle barrel end, the handle having a uniform diameter along the length of the handle extending to the handle barrel end;

a pivot joint element coupled to the handle and pivotally engaging the barrel handle end region of the barrel, the pivot joint element enabling pivotal movement of the barrel with respect to the handle upon an impact with the ball;

a first biasing element coupled to the handle and to the interior surface of the barrel, the first biasing element urging the barrel back into co-axial alignment with the handle following the impact with the ball;

an interface portion coupling the first biasing element and the pivot joint element to the handle;

a cap coupled to the handle and positioned adjacent to a second biasing element;

wherein the cap is positionable in at least first and second positions with respect to the handle and the second biasing element, wherein, when in the first position, the second biasing element resists pivotal movement of the barrel with respect to the cap by a first amount, wherein, when in the second position, the second biasing element resists pivotal movement of the barrel with respect to the cap by a second amount, and wherein the second amount is greater than the first amount.

* * * * *